US006372400B1

(12) United States Patent
Yoshizaki et al.

(10) Patent No.: US 6,372,400 B1
(45) Date of Patent: Apr. 16, 2002

(54) CARRIER FOR USE IN ELECTROPHOTOGRAPHY, TWO-COMPONENT TYPE DEVELOPER AND IMAGE FORMING METHOD

(75) Inventors: Kazumi Yoshizaki; Kenji Okado, both of Mishima; Makoto Kanbayashi, Shizuoka-ken; Yushi Mikuriya, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/606,162

(22) Filed: Jun. 29, 2000

(30) Foreign Application Priority Data

Jun. 30, 1999 (JP) ..... 11-184795
May 31, 2000 (JP) ..... 2000-162386

(51) Int. Cl.[7] ..... G03G 9/113
(52) U.S. Cl. ..... 430/111.32; 430/126
(58) Field of Search ..... 430/106.6, 108, 430/126, 111.32, 111.35

(56) References Cited

U.S. PATENT DOCUMENTS 2,297,691 A 10/1942 Carlson ..... 95/5
5,354,637 A 10/1994 Shimamura et al. ..... 430/106.6
5,641,600 A 6/1997 Kotaki et al. ..... 430/106.6
5,654,120 A * 8/1997 Hakata et al. ..... 430/108
5,994,019 A 11/1999 Okado et al. ..... 430/126
6,042,982 A * 3/2000 Hakata ..... 430/108

FOREIGN PATENT DOCUMENTS

JP 42-23910 11/1967
JP 43-24748 10/1968
JP 9-127736 5/1997

* cited by examiner

*Primary Examiner*—John Goodrow

(57) ABSTRACT

A carrier for use in electrophotography has carrier cores comprising a binder resin and metal compound particles dispersed therein, and a coating resin for coating the surfaces of the carrier cores. Water adsorption $T_{H2O\text{-}H}$ (% by weight) after the carrier has been left in an environment of 30° C./80%RH, water adsorption $T_{H2O\text{-}L}$ (% by weight) after the carrier has been left in an environment of 23° C./5%RH, and particle surface area Sm ($cm^2/g$) of the carrier satisfy the following relationship:

$$6.00\times10^{-6} \leqq T_{H2O\text{-}H}/(100\times Sm) \leqq 1.50\times10^{-5},$$

and $$1.00\times10^{-6} \leqq T_{H2O\text{-}L}/(100\times Sm) \leqq 5.50\times10^{-6}.$$

56 Claims, 5 Drawing Sheets

CARRIER FOR USE IN ELECTROPHOTOGRAPHY, TWO-COMPONENT TYPE DEVELOPER AND IMAGE FORMING METHOD

BACKGROUND OF THE INVENTION

1. Field of the Invention

This invention relates to a magnetic-material-dispersed resin carrier, a two-component type developer having this magnetic-material-dispersed resin carrier and a toner, and an image-forming method making use of this two-component type developer. More particularly, the present invention relates to a magnetic-material-dispersed resin carrier used together with a toner to constitute a two-component type developer for developing an electrostatic latent image by electrophotography, a two-component type developer having this magnetic-material-dispersed resin carrier and a toner, and an image-forming method making use of this two-component type developer.

2. Related Background Art

As electrophotography, various methods are disclosed in U.S. Pat. No. 2,297,691, Japanese Patent Publications No. 42-23910 and No. 43-24748 and so forth. In these methods, copies or prints are obtained by forming an electrostatic latent image on a photoconductive layer upon irradiation of a light image corresponding to an original, subsequently causing a toner to be attracted onto the electrostatic latent image (electrostatically charged image) to develop the electrostatic latent image to form a toner image, and transferring the toner image to a transfer medium such as paper as occasion calls, followed by fixing by heat, pressure, heat and pressure, or solvent vapor.

In recent years, the advancement of computers and multimedia has brought about a demand for means of outputting more highly minute full-color images, which is made in a wide field including offices and up to homes. Heavy-duty users require a running performance high enough to cause any lowering of image quality even in many-sheet copying or printing. In small offices and homes, users demand to enjoy high-quality images and also make apparatus smaller in size from the viewpoints of saving of space and saving of energy, to reuse waste toner or use a waste-tonerless (cleanerless) system and to make fixing temperature lower. To achieve these objects, various studies are being made from individual viewpoints.

In electrophotography, the step of developing the electrostatic latent image is a step where the toner image is formed on an electrostatically charged image by utilizing an electrostatic mutual action between toner particles triboelectrically charged and the electrostatically charged image. Among developers for developing electrostatic latent images by the use of toner, one-component type developers making use of a magnetic toner comprised of a resin having a magnetic material dispersed therein and two-component type developers formed of a blend of a non-magnetic toner and a magnetic carrier are available. In particular, the latter is preferably used in full-color image-forming apparatus such as full-color copying machines and full-color printers, for which a high image quality is required.

Carriers used in the two-component type developers are known to include iron powder carriers, ferrite carriers, and magnetic-material-dispersed resin carriers comprised of a binder resin having magnetic fine particles dispersed therein. In the iron powder carriers, the carrier has so low a specific resistance that the electric charges of the electrostatic latent image may leak through the carrier to disorder the electrostatic latent image to cause faulty images.

In the case when the ferrite carriers are used, having a relatively high specific resistance, the leak of electric charges of the electrostatic latent image through the carrier can not be prevented in some cases, especially in developing methods where alternating electric fields are applied. Since such carriers have a great saturation magnetization, the magnetic brush may become rigid to cause brush marks in toner images.

To solve such problems, the magnetic-material-dispersed resin carriers are proposed which are comprised of a binder resin having magnetic fine particles dispersed therein. Compared with the ferrite carriers, such magnetic-material-dispersed resin carriers have a relatively high specific resistance and also have a small saturation magnetization and a small true specific gravity, and hence the magnetic brush of the carrier does not become rigid and good toner images free of any brush marks can be formed.

Conventional two-component type developers also have a nature of causing what is called "carrier-spent", in which a mechanical impact such as impact between particles themselves and between particles and developing machine components, or heat generation caused by such impact, makes part of toner particles adhere physically to the surfaces of carrier particles to form films. Once this has occurred, films ascribable to toner components come to accumulate gradually on the carrier particle surfaces, so that the triboelectric charging that takes place between carrier particles and toner particles may be displaced by the triboelectric charging that takes place between toner particles themselves, and the triboelectric charging performance of the whole developer may deteriorate to further cause what is called "background fog", a phenomenon in which much toner adheres to the background areas of copied images, resulting in a low copy image quality. Moreover, there is a problem that, where the formation of films ascribable to toner components on the carrier particle surfaces has become remarkable, the whole developer must be changed for new one and this leads to a cost increase.

On the other hand, the magnetic-material-dispersed resin carriers mentioned above have a small saturation magnetization and also have a small true specific gravity, and hence they are advantageous against such carrier-spent and have an advantage that a small true specific gravity enables developing assemblies light-weight.

The magnetic-material-dispersed resin carriers also have less configurational strain in particles and can relatively easily be made to have spherical shape having a high particle strength. Hence, they have superior fluidity and also enable wide control of particle size. Accordingly, they are expected to be applicable in high-speed copying machines and high-speed laser beam printers.

In such magnetic-material-dispersed resin carriers, however, the magnetic material may come off from carrier particles, thus they have room for further improvement in service durability (running performance).

There is a further problem. In the toner used in two-component type developers, it is preferable to add inorganic fine particles as an external additive to the surface of toner particles, for the purpose of improving charging performance, fluidity and transfer performance. When, however, the magnetic-material-dispersed resin carrier is used in combination with a toner to which such inorganic fine particles have externally been added, what is called "external-additive adhesion" may occur, which is a phenomenon in which the hills of unevenness (hills and dales) present at the particle surfaces of the magnetic-material-dispersed resin carrier scrape the inorganic fine particles present on the surfaces of toner particles and the inorganic fine particles thus scraped adhere to the dales. As the result, the charge-providing ability the carrier should imparts to the toner may lower and in addition the charging performance, fluidity and transfer performance of the toner itself may be damaged to cause faulty images.

The external additive having adhered to the dales of particles surfaces of the magnetic-material-dispersed resin carrier behaves like the toner at the time of development, and participates the development on the photosensitive member by the action of an alternating electric field formed at the developing zone upon application of an alternating bias voltage to a developer-carrying member developing sleeve. Thereafter, it is further transferred onto a recording medium and then fixed in a fixing assembly, where part thereof remains on the photosensitive member without being transferred, and is removed by means of a cleaning member and collected in a cleaning assembly. Hence, excessive inorganic fine particles are fed to the fixing assembly and cleaning assembly, so that such inorganic fine particles may shorten the lifetime of the fixing assembly and cleaning assembly and may greatly affect even the main body of the image-forming apparatus.

To solve these problems, a method of coating the particle surfaces of the magnetic-material-dispersed resin carrier with a resin to obtain a resin-coated carrier may preferably be used. Also, since the charging performance of the toner can be controlled with ease by the charging properties of the coating resin, the coating resin may be selected so as to impart the desired electric charges to the toner.

Meanwhile, compared with the ferrite carriers, the magnetic-material-dispersed resin carriers have so much fine unevenness on their particle surfaces and so many fine pores in their particle interiors that it tend to have a high water adsorption. Especially in the case of a polymerization type carrier obtained by polymerization carried out in an aqueous medium, which enables easy formation of spherical particles, monomers to be polymerized have a high affinity for water and come into contact with the water in the course of formation. Hence, such a polymerization carrier tends to have a larger water adsorption than any pulverization type magnetic carriers or any magnetic-material-dispersed resin carriers obtained by polymerization in a hydrophobic solvent, and may cause fog and toner scatter because of an extreme lowering of charging performance, especially in an environment of high temperature and high humidity.

To solve such a problem, Japanese Patent Application Laid-open No. 09-127736 discloses a proposal that the water adsorption in high-temperature and high-humidity environment is controlled to obtain images having a good gradation and a high image density especially in the high-temperature and high-humidity environment.

However, this problem has not been solved in the resin-coated carrier, which is effective for carrier-spent resistance and impact resistance and is advantageous also against toner-spent.

Moreover, compared with the ferrite carriers, the magnetic-material-dispersed resin carriers tend to have a higher resistance, and may come to have a much higher resistance when the particle surfaces are coated with resin in order to solve the above problem. Where images are formed using such a carrier in a low-temperature and low-humidity environment, images with sharp edges can be obtained, but on the other hand a problem may occur such that an image with a large area has a very low image density at its central part. Also, the carrier may be charged with substance other than the toner, such as walls inside a developing assembly to make non-uniform the charge quantity of toner that is to be originally imparted. Such a problem may also occur when carriers are manufactured, leaving a problem on safe manufacture.

As discussed above, taking account of the performances required for carriers, the conventional carriers still remain to have problems to be solved, and are sought to be further improved.

In particular, in the magnetic-material-dispersed resin carriers comprised of a binder resin having magnetic fine particles dispersed therein, it is long awaited to provide a carrier more improved in;

(1) running performance;
(2) environmental properties;
(3) carrier-spent resistance, inclusive of resistance to external-additive adhesion;
(4) charge-providing performance to toner;
(5) development contribution;
(6) prevention of carrier adhesion to the photosensitive member surface; and
(7) prevention of toner deterioration.

SUMMARY OF THE INVENTION

An object of the present invention is to provide a magnetic-material-dispersed resin carrier having solved the above problems, a two-component type developer having such a magnetic-material-dispersed resin carrier and a toner, and an image-forming method making use of this two-component type developer.

Another object of the present invention is to provide a magnetic-material-dispersed resin carrier having a superior running performance, a two-component type developer having such a magnetic-material-dispersed resin carrier and a toner, and an image-forming method making use of this two-component type developer.

Still another object of the present invention is to provide a magnetic-material-dispersed resin carrier having superior environmental properties, a two-component type developer having such a magnetic-material-dispersed resin carrier and a toner, and an image-forming method making use of this two-component type developer.

A further object of the present invention is to provide a magnetic-material-dispersed resin carrier having superior carrier-spent resistance, inclusive of resistance to external-additive adhesion, a two-component type developer having such a magnetic-material-dispersed resin carrier and a toner, and an image-forming method making use of this two-component type developer.

A still further object of the present invention is to provide a magnetic-material-dispersed resin carrier having a superior charge-providing performance to toner, a two-component type developer having such a magnetic-material-dispersed resin carrier and a toner, and an image-forming method making use of this two-component type developer.

A still further object of the present invention is to provide a magnetic-material-dispersed resin carrier that can contribute to the improvement of developing performance, a two-component type developer having such a magnetic-material-dispersed resin carrier and a toner, and an image-forming method making use of this two-component type developer.

A still further object of the present invention is to provide a magnetic-material-dispersed resin carrier effective for the prevention of carrier adhesion to the photosensitive member surface, a two-component type developer having such a magnetic-material-dispersed resin carrier and a toner, and an image-forming method making use of this two-component type developer.

A still further object of the present invention is to provide a magnetic-material-dispersed resin carrier effective for the prevention of toner deterioration, a two-component type developer having such a magnetic-material-dispersed resin carrier and a toner, and an image-forming method making use of this two-component type developer.

To achieve the above objects, the present invention provides a carrier for use in electrophotography, comprising carrier cores comprising a binder resin and metal compound particles dispersed therein, and a coating resin for coating the surfaces of the carrier cores, wherein;

water adsorption $T_{H2O-H}$ (% by weight) after the carrier has been left in an environment of 30° C./80% RH, water adsorption $T_{H2O-L}$ (% by weight) after the carrier has been left in an environment of 23° C./5% RH, and particle surface area Sm ($cm^2/g$) of the carrier satisfy the following relationship.

$$6.00\times10^{-6}\leqq T_{H2O-H}/(100\times Sm)\leqq 1.50\times10^{-5},$$

and $$1.00\times10^{-6}\leqq T_{H2O-L}/(100\times Sm)\leqq 5.50\times10^{-6}.$$

The present invention also provides a two-component type developer comprising a toner and a carrier, wherein;

the toner contains at least a binder resin and a colorant and has a weight-average particle diameter of from 3 $\mu$m to 10 $\mu$m;

the carrier has carrier cores comprising a binder resin and metal compound particles dispersed therein, and a coating resin for coating the surfaces of the carrier cores; and water adsorption $T_{H2O-H}$ (% by weight) after the carrier has been left in an environment of 30° C./80% RH, water adsorption $T_{H2O-L}$ (% by weight) after the carrier has been left in an environment of 23° C./5% RH, and particle surface area Sm ($cm^2/g$) of the carrier satisfy the following relationship.

$$6.00\times10^{-6}\leqq T_{H2O-H}/(100\times Sm)\leqq 1.50\times10^{-6},$$

and $$1.00\times10^{-6}\leqq T_{H2O-L}/(100\times Sm)\leqq 5.50\times10^{-6}.$$

The present invention still also provides an image-forming method comprising the steps of;

charging an electrostatic latent image bearing member electrostatically by a charging means;

exposing the electrostatic latent image bearing member thus charged, to form an electrostatic latent image on the electrostatic latent image bearing member;

developing the electrostatic latent image by a developing means having a two-component type developer, to form a toner image on the electrostatic latent image bearing member;

transferring the toner image formed on the electrostatic latent image bearing member, to a transfer medium via, or not via, an intermediate transfer member; and fixing the toner image transferred onto the transfer medium, by a heat-and-pressure fixing means;

wherein;

the two-component type developer has at least a toner and a magnetic-material-dispersed resin carrier; the toner contains at least a binder resin and a colorant and has a weight-average particle diameter of from 3 $\mu$m to 10 $\mu$m;

the magnetic-material-dispersed resin carrier has carrier cores comprising a binder resin and metal compound particles dispersed therein, and a coating resin for coating the surfaces of the carrier cores; and water adsorption $T_{H2O-H}$ (% by weight) after the carrier has been left in an environment of 30° C./80% RH, water adsorption $T_{H2O-L}$ (% by weight) after the carrier has been left in an environment of 23° C./5% RH, and particle surface area Sm ($cm^2/g$) of the carrier satisfy the following relationship.

$$6.00\times10^{-6}\leqq T_{H2O-H}/(100\times Sm)\leqq 1.50\times10^{-5},$$

and $$1.00\times10^{-6}\leqq T_{H2O-L}/(100\times Sm)\leqq 5.50\times10^{-6}.$$

DESCRIPTION OF THE PREFERRED EMBODIMENTS

Figure 1:
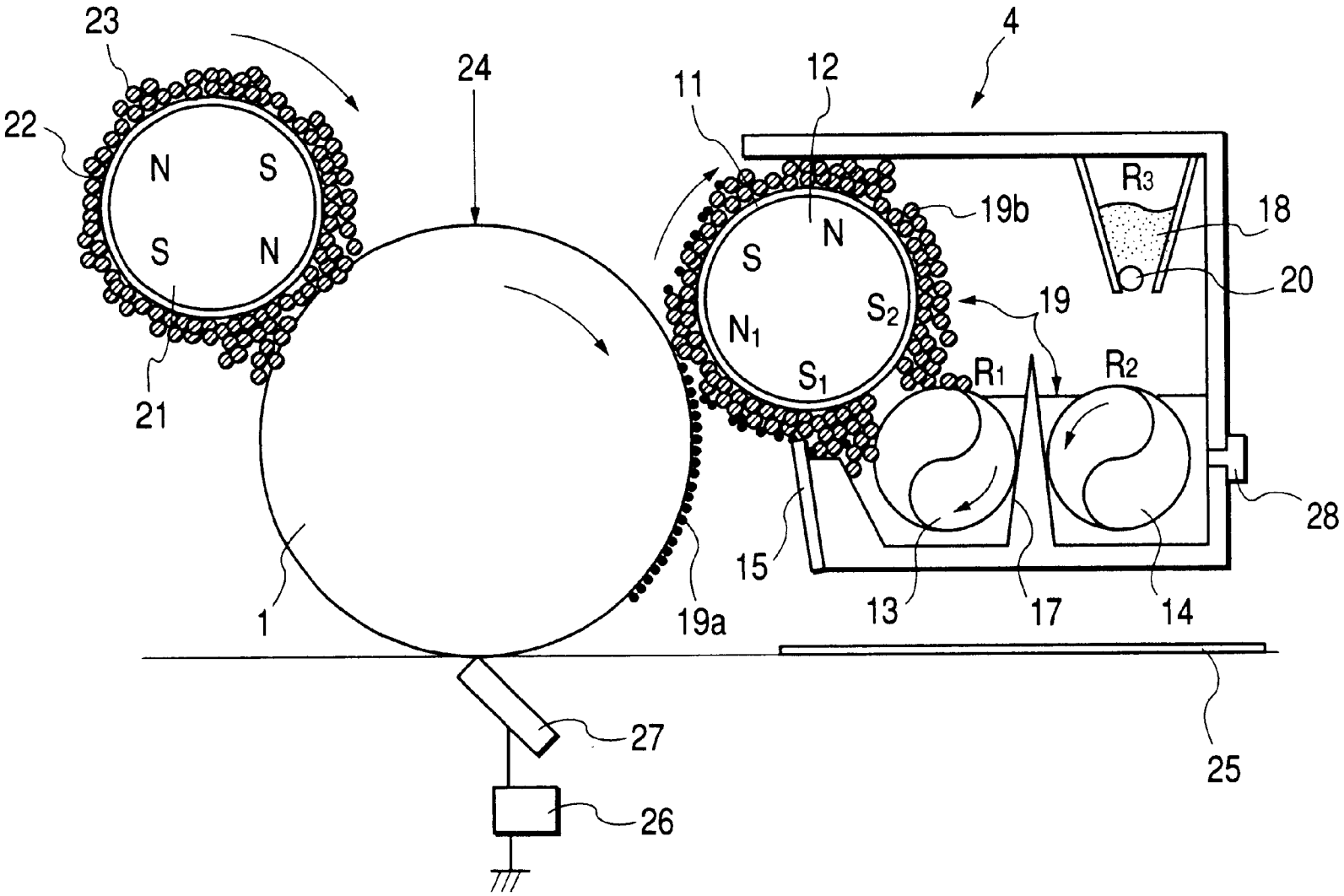
FIG. 1 is a diagrammatic illustration of a preferred example of an image forming apparatus used to carry out the image forming method according to the present invention.

As the result of extensive studies made by the present inventors, they have discovered that a good image quality can be attained over a long period time when, in a magnetic-material-dispersed resin carrier comprising carrier cores comprising a binder resin and metal compound particles dispersed therein, and a coating resin for coating the surfaces of the carrier cores, the carrier has a water adsorption $T_{H2O-H}$ (% by weight) after the carrier has been left in an environment of 30° C./80% RH, a water adsorption $T_{H2O-L}$ (% by weight) after the carrier has been left in an environment of 23° C./5% RH, and a particle surface area Sm ($cm^2/g$), satisfying the following relationship;

$$6.00\times10^{-6}\leqq T_{H2O-H}/(100\times Sm)\leqq 1.50\times10^{-5},$$

and $$1.00\times10^{-6}\leqq T_{H2O-L}/(100\times Sm)\leqq 5.50\times10^{-6};$$

and more preferably, satisfying the following relationship.

$$6.00\times10^{-6}\leqq T_{H2O-H}/(100\times Sm)\leqq 1.20\times10^{-6},$$

and $$1.10\times10^{-6}\leqq T_{H2O-L}/(100\times Sm)\leqq 5.50\times10^{-6}.$$

This will be described below in detail.

If the $T_{H2O-H}/(100\times Sm)$, which is the water adsorption per unit area of the carrier after it has been left in an environment of 30° C./80% RH, is less than $6.00\times10^{-6}$, the heat generation ascribable to mechanical impact inside the developing assembly can not completely be prevented especially in high-temperature environment, tending to cause toner-spent. If the $T_{H2O-H}/(100\times Sm)$ is more than $1.50\times10^{-5}$, the toner may not appropriately be charged because of an excess water adsorption, so that faulty images such as fog and spots around line images tend to occur and also, because of a low specific resistance of the carrier, the development bias may leak through the carrier to disorder the electrostatic latent image formed on the photosensitive member (drum), to cause faulty images.

If the $T_{H2O-L}/(100\times Sm)$, which is the water adsorption per unit area of the carrier after it has been left in an environment of 23° C./5% RH, is less than $1.00\times10^{-6}$, what is called charge-up, a phenomenon in which the carrier imparts excess electric charges to the toner, may occur to consequently cause a decrease in image density especially in low-humidity environment, and, in an extreme case, the electric charges accumulated in the carrier may leak with difficulty and the toner replenished in the developing assembly may not appropriately be charged to cause faulty images, what is called charge-up fog. Also, the carrier may be charged with substance other than the toner, such as walls inside the developing assembly to make non-uniform the charge quantity of toner that is to be originally imparted. Besides, faulty images tend to be caused by, e,g., edge emphasis and electrostatic adhesion of external additives. If the $T_{H2O-L}/(100\times Sm)$ is more than $5.50\times10^{-6}$, the water content is considered to be almost held in the interiors of individual carrier particles rather than on the surfaces thereof, which means that there are many water adsorbing sites, namely, many voids in the interiors of individual carrier particles. As the result, the carrier itself may have a low strength to make it impossible to obtain images which are stable over a long period of time.

As methods of adjusting the water content of the carrier, they may include the following methods (A) to (C).

(A) For example, a method in which it is adjusted by incorporating carrier particle surfaces with hydrophilic and hydrophobic organic functional groups in an appropriate quantity.

(B) For example, a method in which highly hydrophilic and hydrophobic organic and inorganic fine particle layers are made to adhere to carrier particle surfaces in an appropriate quantity.

(C) For example, a method in which, when coat layers comprised of a resin capable of undergoing curing reaction such as silicone resin are formed on carrier core surfaces, the water content of a carrier core material standing immediately before coating is controlled by (i) making moistened nitrogen flow in, (ii) carrying out deaeration under reduced pressure or (iii) previously imbuing carrier cores with a polar solvent such as alcohol or such a polar solvent to which water has been added, whereby the reaction rate of the coating material is controlled to control the functional groups present at the carrier particle surfaces.

In the present invention, the water adsorption $T_{H2O-H}$ (% by weight) after the carrier has been left in an environment of 30° C./80% RH and the water adsorption $T_{H2O-L}$ (% by weight) after the carrier has been left in an environment of 23° C./5% RH are measured by the following measuring method.

Measurement of water adsorption $T_{H2O}$:

Water content is measured by Karl Fischer's titration of a carrier having been left for 24 hours or longer in each environment. As a measuring instrument, an automatic heat vaporization water content measuring system AQ-6, SE-24, manufactured by Hiranuma Sangyo K.K., is used.

First, a toner and a virgin carrier not blended with toner or a carrier obtained after a toner contained in an initial-stage developer having not been put to any image reproduction test is washed away with water to which a surface-active agent such as Contaminon has been added, are vacuum-dried for 24 hours or longer to remove the water content completely.

Thereafter, the carrier from which the water content has been removed is left in an environment of 30° C./80% RH or an environment of 23° C./5% RH to prepare a completely moisture-conditioned sample. Then, the sample, precisely weighed in an amount of 0.8 g, is put in a 20 cc sample tube made of glass, and the sample tube is covered with a lid coated with fluorine grease. Here, in order to make correction for the amount of water content in the air, one empty sample tube covered with a packing of the like type is made ready for use at the same time when the above tube is covered. These are put to titration, and, in the values obtained, a value obtained by subtracting the measured value on the empty sample tube from the measured value on the sample-containing sample tube indicates the amount of water content in the sample. Also, a value obtained by dividing this amount of water content in the sample by the weighed value of the sample and multiplying the resultant value by 100 is the water content of the sample. The titration is made under conditions of heating temperature: 120° C.; carrier gas (nitrogen gas) flow rate: 0.2 L/min; blow gas flow rate: 0.3 L/min; and intervals: 30 seconds. Incidentally, in the titration, Hydranal Aqualite AG, available from Riedel de Haeen Co. (Germany), is used as a generating medium, and Hydranal Aqualite CG, available from Riedel de Haeen Co. (Germany), as a counter-electrode medium.

In the present invention, the particle surface area Sm ($cm^2/g$) of the carrier and 50% particle diameter thereof are measured by the following measuring method.

Measurement of carrier particle surface area Sm ($cm^2/g$):

The particle surface area Sm of the carrier is measured by sphere approximation, using a laser diffraction particle size distribution measuring instrument HELOS having a dry-process dispersion machine RODOS, manufactured by Synpatec Co., under conditions of a feed air pressure of 3 bar and a suction pressure of 0.1 bar. Using this instrument, volume-based 50% particle diameter and particle size distribution of carrier particles are also measured.

The carrier may preferably have a volume-based 50% particle diameter (D) of from 15 to 60 μm, and more preferably from 25 to 50 μm. The carrier may also preferably contain particles having a particle diameter of ⅔ or smaller the 50% particle diameter, $\frac{2}{3}D\geqq$, in an amount of 5% by volume or less, and more preferably from 0.1 to 5% by volume.

If the carrier has a 50% particle diameter smaller than 15 μm, the carrier adhesion to non-image areas that is due to particles present on the side of fine particles in the particle size distribution of the carrier may not be well preventable. If the carrier has a 50% particle diameter larger than 60 μm, though any brush marks caused by a rigidity of the magnetic brush does not occur, uneven images due to its largeness may occur.

If the carrier of the present invention contains, in its particle size distribution, more than 5% by volume of the particles having a particle diameter of ⅔ or smaller the 50% particle diameter, the carrier adhesion due to carrier fine powder tends to occur.

In the present invention, the carrier may preferably have a volume resistivity of from $1\times10^8$ to $1\times10^{16}$ Ω·cm, and more preferably from $1\times10^9$ to $1\times10^{15}$ Ω·cm.

If the carrier has a volume resistivity lower than $1\times10^8$ Ω·cm, the carrier tends to adhere to the photosensitive member surface, tending to scratch the photosensitive member or be directly transferred to transfer paper to cause faulty images. Also, the development bias may leak through the carrier to disorder the electrostatic latent image formed on the photosensitive member (drum).

If the carrier has a volume resistivity higher than $1\times10^{16}$ Ω·cm, edge-emphasized strong-toned images tend to be formed, and also, since electric charges on the carrier particle surfaces may leak with difficulty, the phenomenon of charge-up may occur to cause a decrease in image density, or the toner replenished anew may become not chargeable to cause fog and spots around line images. Also, the carrier may be charged with substance other than the toner, such as walls inside the developing assembly to make non-uniform the charge quantity of toner that is to be originally imparted. Besides, faulty images tend to be caused by, e,g., electrostatic adhesion of external additives.

The volume resistivity of the carrier is measured with a powder insulation resistance meter manufactured by Shinku Riko K.K. As conditions for measurement, a carrier left for 24 hours or longer in an environment of 23° C./60% RH is put in a measuring cell of 20 mm diameter (0.283 $cm^2$), and the cell is held between loading electrodes of 120 $g/cm^2$ to make measurement in a sample thickness of 2 mm and under an applied voltage of 500 V.

As magnetic characteristics of the carrier, it may preferably have a low magnetic force such that its magnetization intensity at 1,000/4 π (kA/m) is from 20 to 100 ($Am^2/kg$), and more preferably from 30 to 65 ($Am^2/kg$).

If the carrier has a magnetization intensity above 100 ($Am^2/kg$), though it concerns carrier particle diameter, the magnetic brush formed on the developing sleeve may have a low density at the development pole to have a large ear length and also become rigid, and hence brush marks tend to appear on the copied images and the developer tends to deteriorate especially as a result of running for copying or printing on many sheets.

If the carrier has a magnetization intensity below 20 ($Am^2/kg$), the carrier may have a low magnetic force even when carrier fine powder is removed, to tend to cause carrier adhesion and tend to result in a low toner transport performance.

The magnetic characteristics of the carrier is measured with an oscillating magnetic field type magnetic characteristics automatic recorder BHV-35, manufactured by Riken Denshi K.K. As conditions for measurement, magnetic characteristics of carrier powder are measured by forming an external electric field of 1,000/4 π (kA/m) and determining the intensity of magnetization when it is formed. More specifically, the carrier powder is put in a cylindrical plastic container to prepare a sample in such a packed state that carrier particles are so well dense as to be immovable. In this state, the magnetization moment is measure and the actual weight of the container containing the sample is measured to determine the magnetization intensity ($Am^2/kg$).

In the present invention, the metal compound particles used in the carrier cores may include particles of a metal compound such as magnetite or ferrite having magnetic properties, represented by the following formula (1) or (2).

$$MO\cdot Fe_2O_3 \quad (1)$$

$$M\cdot Fe_2O_4 \quad (2)$$

wherein M represents a trivalent, divalent or monovalent metal ion.

The metal ion represented by M may include Mg, Al, Si, Ca, Sc, Ti, V, Cr, Mn, Fe, Co, Ni, Cu, Zn, Sr, Y, Zr, Nb, Mo, Cd, Sn, Ba, Pb and Li. Any of these may be used alone or in combination.

As specific compounds of the above metal compound having magnetic properties, it may include iron oxides such as magnetite, Zn—Fe ferrite, Mn—Zn—Fe ferrite, Ni—Zn—Fe ferrite, Mn—Mg—Fe ferrite, Ca—Mn—Fe ferrite, Ca—Mg—Fe ferrite, Li—Fe ferrite and Cu—Zn—Fe ferrite.

In the present invention, as the metal compound particles used in the carrier cores, a mixture of the above metal compound having magnetic properties (i.e., a ferromagnetic material) and the following non-magnetic metal compound may also be used.

Such a non-magnetic metal compound may include, e.g., $Al_2O_3$, $SiO_2$, CaO, $TiO_2$, $V_2O_5$, CrO, $MnO_2$, α-$Fe_2O_3$, CoO, NiO, CuO, ZnO, SrO, $Y_2O_3$, and $ZrO_2$. In this case, one type of the metal compound may be used, or a mixture of at least two types of the metal compound may particularly preferably be used. In such a case, particles having similar specific gravity and shape may more preferably be used in combination, in order to improve adhesion between them and binder resin and strength of the carrier core particles.

As examples of such combination, particularly preferably usable are combinations of magnetite with hematite, magnetite with γ-$Fe_2O_3$, magnetite with $SiO_2$, magnetite with $Al_2O_3$, magnetite with $TiO_2$, magnetite with Ca—Mn—Fe ferrite and magnetite with Ca—Mg—Fe ferrite. Of these, combination of magnetite with hematite may particularly preferably be used.

In the case when the metal compound having magnetic properties is used alone or when it is used in mixture with the non-magnetic metal compound, the metal compound having magnetic properties may preferably have a number-average particle diameter of from 0.02 to 2 μm, and more preferably from 0.05 to 1 μm, which may vary depending on the number-average particle diameter of the carrier cores.

If the metal compound having magnetic properties has a number-average particle diameter smaller than 0.02 μm, preferable magnetic characteristics may be attained with difficulty. If the metal compound having magnetic properties has a number-average particle diameter larger than 2 μm, the carrier having high strength and preferable particle diameter may be obtained with difficulty because of a non-uniformity in granulation.

In the case when the metal compound having magnetic properties and the non-magnetic metal compound are used in the form of a mixture, the non-magnetic metal compound may preferably have a number-average particle diameter of from 0.05 to 5 μm, and more preferably from 0.1 to 3 μm. In this case, the number-average particle diameter of the metal compound having magnetic properties, average particle diameter ra, and the number-average particle diameter of the non-magnetic metal compound, average particle diameter rb, may preferably be a particle diameter ratio (rb/ra) of from 1.0 to 5.0, and more preferably from 1.2 to 5.0.

If the non-magnetic metal compound has a number-average particle diameter smaller than 0.05 μm, no preferable resistance may be attained to tend to cause carrier adhesion. If the non-magnetic metal compound has a number-average particle diameter larger than 5 μm, the carrier having high strength and preferable particle diameter may be obtained with difficulty because of a non-uniformity in granulation.

In addition, if the rb/ra is less than 1.0, the metal compound having magnetic properties, having a low specific resistance, tends to come out to the surface and the specific resistance of carrier cores may be enhanced with difficulty to make it difficult to obtain the effect of preventing carrier adhesion. If the rb/ra is more than 5, the carrier tends to have a low strength to tend to cause carrier break.

To measure the number-average particle diameter of the above metal compounds (metal oxides), at least 300 particles having particle diameters of 0.01 $\mu$m or larger are sampled at random using a photographic image magnified 5,000 to 20,000 times by means of a transmission electron microscope H-800, manufactured by Hitachi Ltd, and their particle diameters are measured as metal oxide particle diameters by horizontal-direction Feret's diameter, using an image processing analyzer LUZEX 3, manufactured by Nireko Co., which are then average-processed to calculate the number-average particle diameter.

As to volume resistivity of the metal compound particles dispersed in the binder resin, the particles of the metal compound having magnetic properties (ferromagnetic material) may preferably have a specific resistance of $1\times10^3$ $\Omega\cdot$cm or above. Especially when the metal compound having magnetic properties and the non-magnetic metal compound are used in the form of a mixture, the particles of the metal compound having magnetic properties may preferably have the volume resistivity of $1\times10^3$ $\Omega\cdot$cm or above and the other non-magnetic metal compound particles may preferably have a specific resistance higher than that of the particles of the metal compound having magnetic properties. The non-magnetic metal compound particles usable in the present invention may preferably be those having a volume resistivity of $1\times10^8$ $\Omega\cdot$cm or above, and more preferably $1\times10^{10}$ $\Omega\cdot$cm or above.

If the particles of the metal compound having magnetic properties has a volume resistivity below $1\times10^3$ $\Omega\cdot$cm, the desired high specific resistance can be attained with difficulty even when contained in a quantity made smaller, tending to cause injection of electric charges and cause deterioration of image quality and carrier adhesion. Also, in the case when the metal compound having magnetic properties and the non-magnetic metal compound are used in the form of a mixture, if the non-magnetic metal compound have a volume resistivity below $1\times10^8$ $\Omega\cdot$cm, the magnetic carrier cores may have a low specific resistance to make it difficult to obtain the effect of the present invention.

In the present invention, the volume resistivity of the metal compound having magnetic properties and that of the non-magnetic metal compound are measured according to the measurement of the volume resistivity of carrier particles.

In the carrier cores in the present invention, the metal compound particles may be contained in an amount of from 80 to 99 parts by weight based on the weight of the carrier cores.

If the metal compound particles are contained in an amount less than 80 parts by weight, an unstable charging performance may result, and, especially in low-temperature and low-humidity environment, the carrier may become charged and its residual electric charges tend to remain, so that the fine powder toner and external additives tend to adhere to the carrier particle surfaces and also no appropriate specific gravity may be attained. If the metal compound particles are contained in an amount more than 99% by weight, the carrier may have a low strength to tend to cause problems such as carrier break as a result of running.

As a preferred embodiment of the present invention, in the carrier cores containing as the metal compound particles the mixture of the metal compound having magnetic properties (ferromagnetic material) and the non-magnetic metal compound, the metal compound having magnetic properties, held in the whole metal compound particles contained, may preferably be in an amount of from 50 to 95% by weight, and more preferably from 55 to 95% by weight.

If the metal compound having magnetic properties, held in the whole metal compound particles contained, is contained in an amount less than 50% by weight, the cores can well be made to have a high specific resistance but on the other hand the carrier itself may have a small magnetic force to cause carrier adhesion. If the metal compound having magnetic properties, held in the whole metal compound particles contained, is contained in an amount more than 95% by weight, the cores may not be made to have a high specific resistance in a more preferable state, depending on the specific resistance of the metal compound having magnetic properties.

The binder resin of the carrier cores (carrier core particles) used in the present invention may preferably be a thermosetting resin and is a resin part or the whole of which has three-dimensionally been cross-linked. This enables firm bind of the metal compound particles to be dispersed, and hence the carrier cores can be made to have a high strength. Thus, the metal compound particles may hardly come off even during copying on many sheets, and also the carrier cores can be coated with the coating resin in a better state, so that the water adsorption of the carrier can readily be controlled within the range of the present invention.

Methods for obtaining magnetic-material-dispersed resin carrier cores may include, but not particularly limited to, the following methods. In the present invention, preferably applicable is a method of producing the carrier cores by polymerization where monomers are polymerized in a medium in which the monomers and a solvent have uniformly been dispersed or dissolved, in particular, a method in which, in the above method, the metal compound particles to be dispersed in the carrier cores are previously subjected to lipophilic treatment to obtain magnetic-material-dispersed resin carrier cores having a sharp particle size distribution and less fine powder.

In the present invention, in the case of a carrier used in combination with a toner having a small particle diameter of from 1 to 10 $\mu$m in weight-average particle diameter, the carrier may preferably be made to have a small particle diameter, too, in accordance with the particle diameter of the toner. The above production method is particularly preferred because a carrier containing less fine powder can be produced by that method without regard to average particle diameter even when the carrier is made to have a small particle diameter.

As the monomers used in the binder resin of the carrier core particles, radical-polymerizable monomers may be used. Such monomers may include, e.g., styrene; styrene derivatives such as o-methylstyrene, m-methylstyrene, p-methoxystyrene, p-ethylstyrene and p-tertiary-butylstyrene; acrylic acid, and acrylates such as methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate and phenyl acrylate; methacrylic acid, and methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminomethyl methacrylate, diethylaminoethyl methacrylate and benzyl methacrylate;

2-hydroxyethyl acrylate and 2-hydroxyethyl methacrylate; acrylonitrile, methacrylonitrile and acrylamide; vinyl ethers such as vinyl methyl ether, vinyl ethyl ether, vinyl propyl ether, vinyl n-butyl ether, vinyl isobutyl ether, vinyl β-chloroethyl ether, vinyl phenyl ether, vinyl p-methylphenyl ether, vinyl p-chlorophenyl ether, vinyl p-bromophenyl ether, vinyl p-nitrophenyl ether and vinyl p-methoxyphenyl ether; and diene compounds such as butadiene.

Any of these monomers may be used alone or in the form of a mixture, and preferable polymer composition may be selected so as to obtain preferred properties.

As stated previously, the binder resin of the carrier core particles may preferably previously be three-dimensionally cross-linked. As cross-linking agents for cross-linking the binder resin three-dimensionally, cross-linking agents having two or more double bonds per one molecule may preferably be used. Such cross-linking agents may include, e.g., aromatic divinyl compounds such as divinylbenzene and divinylnaphthalene; and ethylene glycol diacrylate, ethylene glycol dimethacrylate, triethylene glycol dimethacrylate, tetraethylene glycol dimethacrylate, 1,3-butylene glycol dimethacrylate, trimethylolpropane triacrylate, trimethylolpropane trimethacrylate, 1,4-butanediol diacrylate, neopentyl glycol diacrylate, 1,6-hexanediol diacrylate, pentaerythritol triacrylate, pentaerythritol tetraacrylate, pentaerythritol dimethacrylate, pentaerythritol tetramethacrylate, glycerol acroxydimethacrylate, N,N-divinylaniline, divinyl ether, divinyl sulfide and divinyl sulfone. Any of these may be used in the form of an appropriate mixture of two or more types. The cross-linking agent may previously be mixed in a polymerizable mixture, or may optionally appropriately be added in the middle of polymerization.

Other monomers for the binder resin of the carrier core particles may include bisphenols and epichlorohydrin which serve as starting materials for epoxy resins; phenols and aldehydes, for phenolic resins; urea and aldehydes, for urea resins; and melamine and aldehydes, for melamine resins.

Most preferred binder resins are phenolic resins. Starting materials therefor may include phenolic compounds such as phenol, m-cresol, 3,5-xylenol, p-alkylphenols, resorcinol, p-tert-butylphenol; and aldehyde compounds such as formalin, paraformaldehyde and furfural. In particular, combination of phenol with formalin is preferred.

In the case when these phenolic resins or melamine resins are used, basic catalysts may be used as curing catalysts. As the basic catalysts, various ones used in conventional resol resin production may be used. Stated specifically, such catalysts may include amines such as ammonia water, hexamethylenetetramine, diethyltriamine and polyethyleneimine.

In the present invention, the metal compound particles contained in the carrier cores may previously be lipophilic-treated in order to make the carrier cores (carrier core particles) have a sharp particle size distribution and to prevent the metal compound particles from coming off from the carrier cores. In the case when such carrier core particles having the lipophilic-treated metal compound particles dispersed therein are formed, the polymerization reaction proceeds in the medium in which monomers and a solvent have uniformly been dispersed or dissolved, and particles having turned insoluble in solution are simultaneously formed. When such particles are formed, it is considered that there are the action to bring the metal compound being incorporated into the particles in a uniform and highly dense state and the action to prevent the particles from mutually agglomerating and make them have a sharp particle size distribution. Also, in the case when such lipophilic-treated metal compound particles are used, it is unnecessary to use any suspension stabilizer such as calcium fluoride. This can prevent the inhibition of charging performance that may occur when any suspension stabilizer remains on the carrier particle surfaces, can prevent the coating resin from being non-uniformly coated, and can prevent the inhibition of reaction that may occur when a reactive resin such as silicone resin is coated. Still also, the absence of any suspension stabilizer on the surface and the prevention of any difficulties such a suspension stabilizer may involve make it easy to control the water adsorption of the carrier within the range of the present invention.

The lipophilic treatment may preferably be treated with a lipophilic-treating agent which is an organic compound having at least one functional group selected from an epoxy group, an amino group and a mercapto group, or a mixture thereof. In particular, a lipophilic-treating agent having an epoxy group may preferably be used in order to readily achieve the range of the water adsorption specified in the present invention and obtain a carrier having stable charge-providing ability.

The metal compound particles may preferably be treated with the lipophilic-treating agent used in an amount of from 0.1 to 10 parts by weight, and more preferably from 0.2 to 6 parts by weight, based on 100 parts by weight the metal compound particles. This is preferable in order to improve the lipophilicity and hydrophobicity of the metal compound particles.

The lipophilic-treating agent having an epoxy group may include γ-glycidoxypropylmethyldiethoxysilane, γ-glycidoxypropyltrimethoxysilane, β-(3,4-epoxycyclohexyl)trimethoxysilane, epichlorohydrin, glycidol and a styrene-glycidyl acrylate or methacrylate copolymer.

As the lipophilic-treating agent having an amino group, usable are, e.g., γ-aminopropyltrimethoxysilane, γ-aminopropylmethoxydiethoxysilane, γ-aminopropyltriethoxysilane, N-β-(aminoethyl)-γ-aminopropyltrimethoxysilane, N-β-(aminoethyl)-γ-aminopropylmethyldimethoxysilane, N-phenyl-γ-aminopropyltrimethoxysilane, ethylenediamine, ethylenetriamine, a styrene-dimethylaminoethyl acrylate or methacrylate copolymer and isopropyl tri(N-aminoethyl) titanate.

As the lipophilic-treating agent having a mercapto group, usable are, e.g., mercaptoethanol, mercaptopropionic acid and γ-mercaptopropyltrimethoxysilane.

There are no particular limitations on the resin with which the carrier core surfaces are coated. Stated specifically, it may include, e.g., acrylic resins such as polystyrene and styrene-acrylic copolymers; vinyl chloride, vinyl acetate, polyvinylidene fluoride resins, fluorocarbon resins, perfluorocarbon resins, solvent-soluble perfluorocarbon resins, polyvinyl alcohol, polyvinyl acetal, polyvinyl pyrrolidone, petroleum resins, cellulose, cellulose derivatives, novolak resins, low-molecular weight polyethylene, saturated alkyl polyester resins, aromatic polyester resins, polyamide resins, polyacetal resins, polycarbonate resins, polyether sulfone resins, polysulfone resins, polyphenylene sulfide resins, polyether ketone resins, phenolic resins, modified phenolic resins, maleic resins, alkyd resins, epoxy resins, acrylic resins, unsaturated polyesters obtained by polycondensation of maleic anhydride with terephthalic acid and polyhydric alcohol, urea resins, melamine resins, urea-melamine resins, xylene resins, toluene resins, guanamine resins, melamine-guanamine resins, acetoguanamine resins, glyptal resins, furan resins, silicone resins, polyimide resins, polyamide-imide resins, polyether-imide resins, and polyurethane resins.

In particular, silicone resins may preferably be used from the viewpoint of adhesion to cores and prevention of carrier-spent. The silicone resin may be used alone, and may preferably be used in combination with a coupling agent in order to enhance the strength of coat layers and make control to preferable charging. Part of such a coupling agent may also preferably be used as what is called a primer, which is used to treat carrier core surfaces before they are coated with the resin. The coat layers to be formed thereafter can be formed in the state they have a higher adhesion, concurrent with covalent bonding.

As the coupling agent, an aminosilane may be used. As the result, amino groups having positive chargeability can be introduced to the carrier particle surfaces, and negative chargeability can well be imparted to the toner. Also, the presence of amino groups contributes to activation of both the lipophilic-treating agent with which the metal compound particles have preferably been treated and the silicone resin with which the carrier core surfaces are coated. Hence, the adhesion between the silicone resin and the carrier cores can be more improved and at the same time the curing of the resin can be accelerated, so that firmer coat layers can be formed.

At the time of coating treatment to form the coat layers, the carrier core surfaces may preferably be coated under reduced pressure at a temperature of from 30° C. to 80° C.

The reason therefor is unclear, and is presumed to be what is described in the following (1) to (3).

(1) The water content held by the carrier cores is used in the activation of the resin, so that the water content as the whole carrier can appropriately be controlled.

(2) The reaction proceeds appropriately at the stage of coating, so that the carrier core surfaces can uniformly and smoothly be coated with the coating resin.

(3) In the step of baking, low-temperature treatment at 160° C. or below at least can be made, so that the resin can be prevented from being excessively cross-linked and the coat layers can be improved in durability.

In the final step, a moisture-conditioning step may preferably be provided in which the coated particles are left for at least 24 hours in normal environment of, e.g., 23° C./60RH. As the result, any water content which has been lost on heating in the step of baking can swiftly be controlled back within the constitution of the present invention. Also, what is called "carrier's self-charging", in which the carrier itself holds electric charges upon mutual contact with carrier particles in the step of baking or upon contact with walls and so forth of apparatus to come to have a low charge-providing ability to toner, can be relieved to make it possible to impart stable charging to the toner.

The toner used in combination with the above carrier to make up the two-component type developer contains at least a binder resin for toner and a colorant. It is particularly effective for the toner to have a weight-average particle diameter of from 3 to 10 $\mu$m, and preferably from 3 to 8 $\mu$m. If the toner has a weight-average particle diameter smaller than 3 $\mu$m, the problem of charge-up tends to occur especially in low-humidity environment, making it difficult to obtain the effect attributable to the use of the carrier of the present invention, and also making the toner itself have low handling properties as powder. If the toner has a weight-average particle diameter larger than 10 $\mu$m, problems such as spots around line images and fog tend to occur especially in high-temperature and high-humidity environment, making it impossible to well obtain the effect attributable to the use of the carrier of the present invention. Also, since individual toner particles are large, it is difficult to obtain a high-resolution and minute images. Moreover, when electrostatic transfer is carried out, toner scatter tends to occur.

The average particle diameter and particle size distribution of the toner are measured in the following way.

To 100 to 150 ml of an electrolytic solution, 0.1 to 5 ml of a surface active agent (alkylbenzene sulfonate) is added, and 2 to 20 mg of a sample to be measured is added thereto. The electrolytic solution in which the sample has been suspended is subjected to dispersion for 1 minute to 3 minutes by means of an ultrasonic dispersion machine. Particle size distribution of toner particles of 0.3 to 40 $\mu$m diameters is measured on the basis of volume, by means of Coulter Counter Multisizer, using an aperture of, e.g., 17 $\mu$m or 100 $\mu$m adapted appropriately to toner particle size. Number-average particle diameter and weight-average particle diameter measured under these conditions are determined by computer processing. Then the cumulative proportion in cumulative distribution of diameter ½ time or less the number-average particle diameter is calculated from number-based particle size distribution to determine the cumulative value of diameter ½ time or less the number-average particle diameter. Similarly, the cumulative proportion in cumulative distribution of diameter twice or more the weight-average particle diameter is calculated from volume-based particle size distribution to determine the cumulative value of diameter twice or more the weight-average particle diameter.

As the toner used in combination with the carrier of the present invention as described above, the present invention is particularly effective when the toner contains at least a polyester resin as the binder resin for toner. More specifically, the polyester resin contributes to good fixing performance and color-mixing properties and is preferably used especially as a binder resin for color toner, but on the other hand has had a problem that it has so strong a negative chargeability as to tend to provide excessive charging especially in low-humidity environment. However, when it is used in combination with the carrier of the present invention, the toner can be kept from excessive charging and a superior developing performance can be attained.

Other binder resins for toner may include, e.g., polystyrene; polymeric compounds obtained from styrene derivatives such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl $\alpha$-chloromethacrylate copolymer, a styrene-acrylonitrile copolymer, a styrene-methyl vinyl ketone copolymer, a styrene-butadiene copolymer, a styrene-isoprene copolymer and a styrene-acrylonitrile-indene copolymer; polyvinyl chloride, phenolic resins, modified phenolic resins, maleic resins, acrylic resins, methacrylic resins, polyvinyl acetate, and silicone resins; polyester resins having as a structural unit a monomer selected from aliphatic polyhydric alcohols, aliphatic dicarboxylic acids, aromatic dicarboxylic acids, aromatic dialcohols and diphenols; and polyurethane resins, polyamide resins, polyvinyl butyral, terpene resins, cumarone indene resins, and petroleum resins.

The toner may also more preferably have a shape factor SF-1 of from 100 to 120.

Toners having a shape factor SF-1 greater than 120 tend to make developers have so great a change in fluidity as to tend to cause changes in charge quantity in a long-term running test. The toner having the SF-1 within the range of from 100 to 120 can be transferred onto paper in so high an efficiency that it can provide substantially the same density as conventional toners even when laid on the photosensitive member in a smaller quantity. This is advantageous in view of cost, too. Also, such a toner can so readily roll over the carrier and also so readily enhance developer's packing density that it has many times of contact with the carrier and can readily hold an always stable charge.

The shape factor SF-1 of the toner is measured by sampling at random at least 300 particles of an toner image (magnifications: about 300) by the use of FE-SEM (field-emission scanning electron microscope) S-800, manufactured by Hitachi Ltd., and introducing its image information into an image processing analyzer LUZEX 3, manufactured by Nireko Co., via an interface. The value calculated from the following equation is defined to be the shape factor SF-1 of the toner.

$$SF\text{-}1=(MXLNG)^2/AREA\times\pi/4\times100$$

wherein MXLNG represents a maximum diameter of a toner particle, and AREA represents a projected area of the toner particle.

A toner having core/shell structure the core of which is formed of a low-softening substance by encapsulating the low-softening substance into toner particles and the shell of which is formed of a shell resin may also preferably be used. Such a toner makes use of a low-softening substance, and hence the toner has been made advantageous for low-temperature fixing but tends to be disadvantageous for heat generation due to mechanical shearing, so that it may cause toner-spent inside a developing assembly. However, the use of the carrier of the present invention eliminates such a possibility.

As a specific method by which the low-softening substance is encapsulated into toner particles, a low-softening substance whose material polarity in an aqueous medium is set smaller than the chief monomer may be used and also a small amount of resin or monomer with a greater polarity may be added. Thus, the toner particles having core/shell structure can be obtained.

The particle size distribution and particle diameter of the toner particles may be controlled by a method in which the types and amounts of slightly water soluble inorganic salts or dispersants having the action of protective colloids are changed, or by controlling stirring conditions such as rotor peripheral speed, pass times and stirring blade shapes, and the shape of vessels or the solid matter concentration in aqueous mediums, whereby the intended toner of the present invention can be obtained.

The shell resin of such a toner may include styrene-acrylic or methacrylic copolymers, polyester resins, epoxy resins, and styrene-butadiene copolymers.

When the toner particles are directly obtained by polymerization, monomers constituting the above resin may preferably be used. Stated specifically, preferably usable are styrene; styrene monomers such as o-, m- or p-methylstyrene and m- or p-ethylstyrene; acrylate or methacrylate monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile, and acrylic acid amide.

In such a toner, at least one of fine silica particles and fine titanium oxide particles may be used as an external additive. This is preferable because the developer can well be endowed with fluidity and the developer can be improved in service life. Use of such fine particles also brings about a developer that may undergo less environmental variations.

Other external additives may preferably include fine metal oxide powder (such as aluminum oxide, strontium titanate, cerium oxide, magnesium oxide, chromium oxide, tin oxide and zinc oxide powders), fine nitride powder (such as silicon nitride powder), fine carbide powder (such as silicon carbide powder), fine metal salt powder (such as calcium sulfate, barium sulfate and calcium carbonate powders), fine fatty acid metal salt powder (such as zinc stearate and calcium stearate powders), carbon black, fine resin powder (such as polytetrafluoroethylene, polyvinylidene fluoride, polymethyl methacrylate, polystyrene and silicone resin powders).

Any of these external additives may be used alone or in combination of two or more. The above external additives, inclusive of silica fine powder, may more preferably be those having been subjected to hydrophobic treatment.

The external additive described above may preferably have a number-average particle diameter of 0.2 $\mu$m or smaller. If it has a number-average particle diameter larger than 0.2 $\mu$m, the toner may have a low fluidity to bring about a low image quality at the time of development and transfer.

The external additive may preferably be used in an amount of from 0.01 to 10 parts by weight, and more preferably from 0.05 to 5 parts by weight, based on 100 parts by weight of toner particles.

The external additive may preferably be those having a specific surface area of 30 $m^2/g$ or larger, and more preferably from 50 to 400 $m^2/g$, as measured using nitrogen adsorption by the BET method.

The treatment to mix the toner particles and the external additive may be made by means of a mixing machine such as Henschel mixer.

In the present invention, the colorant used in the toner may include the following.

As yellow colorants, compounds as typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147 and 168 may preferably be used.

As magenta colorants, condensation azo compounds, diketopyroropyyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 may preferably be used.

As cyan colorants, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may preferably be used.

Any of these colorants may be used alone, in the form of a mixture, or in the state of a solid solution.

As a black colorant, it may include carbon black, and colorants toned in black by the use of the yellow, magenta and cyan colorants shown above.

The colorants are, in the case of color toners, selected taking account of hue angle, chroma, brightness, weatherability, transparency on OHP films and dispersibility in toner particles. The colorant may be added in an an amount of from 1 to 20 parts by weight based on 100 parts by weight of the binder resin for toner.

As a charge control agent used in the toner, known agents may be used. In the case of color toners, it is particularly preferable to use charge control agents that are colorless or light-colored, make toner charging speed higher and are capable of stably maintaining a constant charge quantity. In the present invention, in the case when polymerization methods are used to obtain the toner particles, charge control agents having neither polymerization inhibitory action nor solubilizates in the aqueous medium are particularly preferred. Also, the toner used in the developer may preferably have at least one peak in the range of from 280 nm to 350 nm when its absorbance is measured on an extract obtained by extraction with 0.1 mol/liter of sodium hydroxide. This peak is a peak due to oxycarboxylic acids preferably used in toners for the purposes of, e.g., controlling charging and accelerating the curing of binder resins to improve fluidity. Such oxycarboxylic acids can make toners have a high charging performance, but, depending on binder resins and other materials and toner production methods, may cause an extreme decrease in charge quantity in high-humidity environment or charge-up of toner in low-humidity environment. Accordingly, there has been a limit to their use.

However, the use of the carrier of the present invention has made it possible to effectively control the phenomenon of charge-up of toner especially in low-humidity environment.

To make the extraction with sodium hydroxide, 1 g of toner is weighed and added to 50 ml of 0.1 mol/liter of sodium hydroxide, and these are stirred at 50 rpm by means of a stirrer to effect uniform dispersion. Dispersion treatment is made for 3 hours, followed by filtration with a membrane filter (pore size: 0.45 $\mu$m), and the absorbance of the resultant filtrate is measured.

As negative charge control agents, preferably usable are, e.g., metal compounds of salicylic acid, dialkylsalicylic acid, naphthoic acid, dicarboxylic acids or derivatives of these, polymer type compounds having sulfonic acid or carboxylic acid in the side chain, boron compounds, urea compounds, silicon compounds, and carixarene. As positive charge control agents, preferably usable are, e.g., quaternary ammonium salts, polymer type compounds having such a quaternary ammonium salt in the side chain, guanidine compounds, and imidazole compounds.

The charge control agent may preferably be used in an amount of from 0.5 to 10 parts by weight based on 100 parts by weight of the binder resin. However, the addition of the charge control agent to the toner particles is not essential.

As methods for producing the toner particles, they may include a method in which the binder resin, the colorant and other internal additives are melt-kneaded and the kneaded product obtained is cooled, followed by pulverization and classification; a method in which toner particles are directly produced by suspension polymerization; a dispersion polymerization method in which toner particles are directly produced using an aqueous organic solvent in which monomers are soluble and polymers obtained are insoluble; and a method in which toner particles are produced by emulsion polymerization, as typified by soap-free polymerization in which toner particles are formed by direct polymerization in the presence of a water-soluble polar polymerization initiator.

In the present invention, the method of producing toner particles by suspension polymerization is preferred, which can control the shape factor SF-1 of the toner to 100 to 120 and by which fine-particle toners having a sharp particle size distribution and a weight-average particle diameter of from 3 to 10 $\mu$m can be obtained relatively with ease.

When the polymerization is used to produce the toner particles, the polymerization initiator may include, e.g., azo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide and lauroyl peroxide; any of which may be used.

The polymerization initiator may commonly be used in an amount of from 0.5 to 20% by weight based on the weight of the polymerizable monomer, which varies depending on the intended degree of polymerization. The polymerization initiator may a little vary in type depending on the methods for polymerization, and may be used alone or in the form of a mixture, making reference to its 10-hour half-life period temperature. In order to control the degree of polymerization, any known cross-linking agent, chain transfer agent and polymerization inhibitor may further be added.

In the case when suspension polymerization is used as a toner production process, a dispersant may be used, including, e.g., as inorganic oxides, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, it may include polyvinyl alcohol, gelatin, methyl cellulose, methyl hydroxypropyl cellulose, ethyl cellulose, carboxymethyl cellulose sodium salt, and starch. These are dispersed in an aqueous phase when used. Any of these dispersants may preferably be used in an amount of from 0.2 to 10.0 parts by weight based on 100 parts by weight of the polymerizable monomer.

As these dispersants, those commercially available may be used as they are. In order to obtain dispersed particles having a fine and uniform particle size, however, fine particles of the inorganic compound may be formed in a dispersion medium under high-speed agitation. For example, in the case of tricalcium phosphate, an aqueous sodium phosphate solution and an aqueous calcium chloride solution may be mixed under high-speed agitation, whereby a dispersant preferable for the suspension polymerization can be obtained. Also, in order to make the particles of these dispersants finer, 0.001 to 0.1% by weight of a surface active agent may be used in combination. Stated specifically, commercially available nonionic, anionic or cationic surface active agents may be used. For example, preferably usable are sodium dodecyl sulfate, sodium tetradecyl sulfate, sodium pentadecyl sulfate, sodium octyl sulfate, sodium oleate, sodium laurate, potassium stearate and calcium oleate.

When direct polymerization is employed in the toner production process, the toner can be produced specifically by a production process as described below. A monomer composition prepared by adding in a polymerizable monomer a low-softening substance release agent, a colorant, a charge control agent, a polymerization initiator and other additives, and uniformly dissolving or dispersing them by means of a homogenizer or an ultrasonic dispersion machine, is dispersed in an aqueous medium containing a dispersion stabilizer, by means of a conventional stirrer or a homomixer or a homogenizer. Granulation is carried out preferably while controlling the stirring speed and time so that droplets formed of the monomer composition can have the desired toner particle size. After the granulation, stirring may be carried out to such an extent that the state of particles is maintained and the particles can be prevented from settling by the acton of the dispersion stabilizer. The polymerization may be carried out at a polymerization temperature set at 40° C. or above, usually from 50 to 90° C. At the latter half of the polymerization, the temperature may be raised, and also the aqueous medium may be removed in part at the latter half of the reaction or after the reaction has been completed, in order to remove unreacted polymerizable monomers, by-products and so forth. After the reaction has been completed, the toner particles formed are collected by washing and filtration, followed by drying. In the suspension polymerization, water may preferably be used as the dispersion medium usually in an amount of from 300 to 3,000 parts by weight based on 100 parts by weight of the monomer composition.

The toner thus obtained may be classified to control its particle size distribution. As a method therefor, a multi-division classifier that utilizes inertia force may preferably be used. Use of such a classifier enables efficient production of toners having particle size distribution preferable in the present invention.

Quantity of triboelectricity of the toner is measured in the manner described below.

The toner and the carrier are blended in an appropriate blend proportion (toner: 2 to 15% by weight), and are mixed for 120 second by means of a Turbler mixer. The resultant blended powder (a developer) is put in a container made of a metal at the bottom of which a conductive screen of 635 meshes is provided, and then sucked by means of a suction device. The quantity of triboelectricity is determined from the difference in weight before and after the suction and from the potential accumulated in a capacitor connected to the container. Here, suction pressure is set at 250 mmHg. By this method, the quantity of triboelectricity (Q) is calculated according to the following equation.

$$Q(\mu C/g)=(C\times V)/(W1-W2)$$

wherein W1 is the weight before suction, W2 is the weight after suction, C is the capacity of the capacitor, and V is the potential accumulated in the capacitor.

The image-forming method of the present invention will be described below.

The image-forming method of the present invention comprises charging an electrostatic latent image bearing member electrostatically by a charging means; exposing the electrostatic latent image bearing member thus charged, to form an electrostatic latent image on the electrostatic latent image bearing member; developing the electrostatic latent image by a developing means having a two-component type developer, to form a toner image on the electrostatic latent image bearing member; transferring the toner image formed on the electrostatic latent image bearing member, to a transfer medium via, or not via, an intermediate transfer member; and fixing the toner image transferred onto the transfer medium, by a heat-and-pressure fixing means.

The image-forming method of the present invention will be described below with reference to the accompanying drawings.

In an image forming apparatus shown in FIG. 1, a magnetic brush comprised of magnetic particles 23 is formed on the surface of a transport sleeve 22 by the action of a magnetic force a magnet roller 21 has. This magnetic brush is brought into touch with the surface of an electrostatic latent image bearing member (photosensitive drum) 1 to charge the photosensitive drum 1 electrostatically. A charging bias is kept applied to the transport sleeve 22 by a bias applying means (not shown). The photosensitive drum 1 thus charged is exposed to laser light 24 by means of an exposure unit to form a digital electrostatic latent image. The electrostatic latent image thus formed on the photosensitive drum 1 is developed with a toner 19*a* held in a two-component type developer 19 carried on a developing sleeve 11 internally provided with a magnet roller 12 and to which a development bias is kept applied by a bias applying means (not shown).

The inside of a developing assembly 4 as the developing means is partitioned into a developer chamber R1 and an agitator chamber R2 by a partition wall 17, and is provided with developer transport screws 13 and 14, respectively. At the upper part of the agitator chamber R2, a toner storage chamber R3 holding a replenishing toner 18 is formed. At the lower part of the toner storage chamber R3, a supply opening 20 is provided.

As the developer transport screw 13 is rotatingly driven, the two-component type developer 19 held in the developer chamber R1 is unidirectionally transported in the longitudinal direction of the developing sleeve 11 while being agitated. The partition wall 17 is provided with openings (not shown) on this side and the inner side as viewed in the drawing. The two-component type developer transported to one side of the developer chamber R1 by the screw 13 is sent into the agitator chamber R2 through the opening on the same side of the partition wall 17, and is delivered to the developer transport screw 14. The screw 14 is rotated in the direction opposite to the screw 13. Thus, in the time the two-component type developer in the agitator chamber R2, the two-component type developer delivered from the developer chamber R1 and the toner replenished from the toner storage chamber R3 are agitated and blended, the developer is transported inside the agitator chamber R2 in the direction opposite to the screw 13 and is sent into the developer chamber R1 through the opening on the other side of the partition wall 17.

To develop the electrostatic latent image formed on the photosensitive drum 1, the two-component type developer 19 held in the developer chamber R1 is drawn up by the magnetic force of the magnet roller 12, and is carried on the surface of the developing sleeve 11. The two-component type developer 19 carried on the surface of the developing sleeve 11 is transported to a regulating blade 15 as the developing sleeve 11 is rotated, where the developer is regulated into a developer thin layer with a proper layer thickness. Thereafter, it reaches a developing zone where the developing sleeve 11 faces the photosensitive drum 1. In the magnet roller 12 at its part corresponding to the developing zone, a magnetic pole (development pole) N1 is positioned, and the development pole N1 forms a magnetic field at the developing zone. This magnetic field causes the developer to rise in ears, thus the magnetic brush of the two-component type developer 19 is formed in the developing zone. Then, the magnetic brush comes into touch with the photosensitive drum 1. The toner 19*a* attracted to the magnetic brush and the toner 19*a* attracted to the surface of the developing sleeve 11 are moved to and become attracted to the region of the electrostatic latent image on the photosensitive drum 1, where the electrostatic latent image is developed, thus a toner image is formed.

The two-component type developer 19 having passed through the developing zone is returned into the developing assembly 4 as the developing sleeve 11 is rotated, then stripped off from the developing sleeve 11 by a repulsive magnetic field formed between magnetic poles S1 and S2, and dropped into the developer chamber R1 and agitator chamber R2 so as to be collected there.

Once a T/C ratio (blend ratio of toner and carrier, i.e., toner concentration in the developer) of the two-component type developer in the developing assembly 4 has lowered as a result of the above development, the toner 18 is replenished from the toner storage chamber R3 to the agitator chamber R2 in the quantity corresponding to the quantity of the toner consumed by the development, thus the T/C ratio of the two-component type developer is maintained at a prescribed value. To detect the T/C ratio of the two-component type developer 19 in the developing assembly 4, a toner concentration detecting sensor 28 is used which measures changes in permeability of the two-component type developer 19 by utilizing the inductance of a coil. The toner concentration detecting sensor 28 has a coil (not shown) on its inside.

A developer regulation blade 15 provided beneath the developing sleeve 11 to regulate the layer thickness of the two-component type developer 19 on the developing sleeve 11 is a non-magnetic blade 15 made of a non-magnetic material such as aluminum or SUS316 stainless steel. The distance between its end and the face of the developing sleeve 11 is 300 to 1,000 $\mu$m, and preferably 400 to 900 $\mu$m. If this distance is smaller than 300 $\mu$m, the magnetic carrier may be caught between them to tend to make the developing layer uneven, and also the two-component type developer necessary for performing good development may be coated on the sleeve with difficulty, so that developed images with a low density and much unevenness may be obtained. In order to prevent uneven coating (what is called the blade clog) due to unauthorized particles included in the developer, the distance may preferably be 400 $\mu$m or larger. If it is larger than 1,000 $\mu$m, the quantity of the developer coated on the developing sleeve 11 increases to make it difficult to make desired regulation of the developer layer thickness, so that the magnetic carrier particles adhere to the photosensitive drum 1 in a large quantity and also the circulation of the two-component type developer and the control of the two-component type developer by the non-magnetic blade 15 may become less effective to tend to cause fog because of a decrease of triboelectricity of the toner.

This layer of magnetic carrier particles, even when the developing sleeve 11 is rotatingly driven in the direction of an arrow, moves slower as it separates from the sleeve surface in accordance with the balance between the binding force exerted by magnetic force and gravity and the transport force acting toward the transport of the developing sleeve 11. Some particles drop by the effect of gravity.

Accordingly, the position to arrange the magnetic poles N and S and the fluidity and magnetic properties of the magnetic carrier particles may appropriately be selected, so that the magnetic carrier particle layer is transported toward the magnetic pole N1 as it stands nearer to the sleeve, to form a moving layer. Along this movement of the magnetic carrier particles, the developer is transported to the developing zone as the developing sleeve 11 is rotated, and participates in development.

The toner image formed by development is transferred onto a transfer medium (recording medium) transported to a transfer zone, by means of a transfer blade 27 which is a transfer means to which a transfer bias is kept applied by a bias applying means 26. The toner image thus transferred onto the transfer medium is fixed to the transfer medium by means of a fixing assembly (not shown). Transfer residual toner remaining on the photosensitive drum 1 without being transferred to the transfer medium in the transfer step is charge-controlled in the charging step and collected at the time of development.

Figure 3:
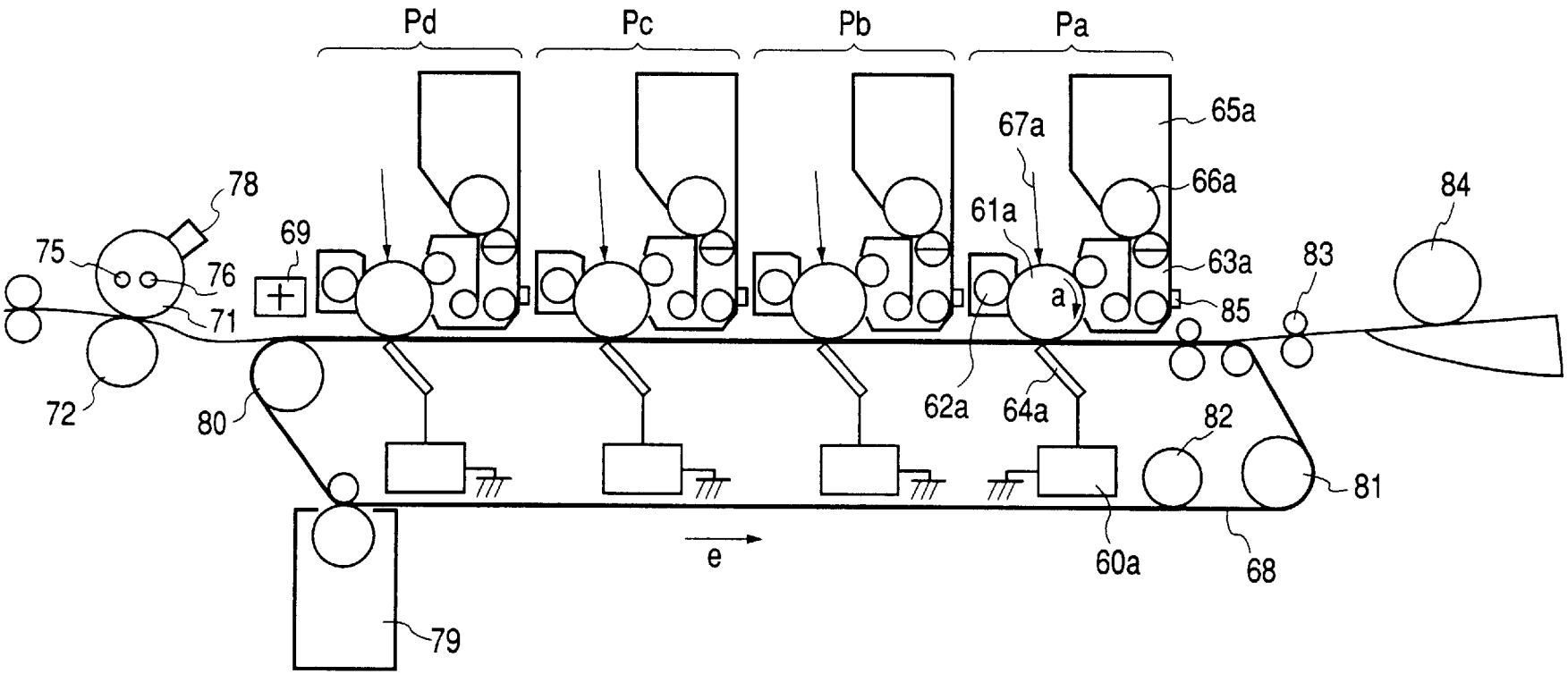
FIG. 3 is a schematic illustration of an example of a full-color image forming apparatus used to carry out the image forming method of the present invention.

FIG. 3 schematically illustrates an example in which the image-forming method of the present invention is applied to a full-color image-forming apparatus.

The main body of the full-color image-forming apparatus is provided side by side with a first image-forming unit Pa, a second image-forming unit Pb, a third image-forming unit Pc and a fourth image-forming unit Pd, and images with respectively different colors are formed on a transfer medium through the process of latent image formation, development and transfer.

The respective image-forming unit provided side by side in the image-forming apparatus are each constituted as described below taking the case of the first image-forming unit Pa.

The first image-forming unit Pa has an electrophotographic photosensitive drum 61*a* of 30 mm diameter as the electrostatic latent image bearing member. This photosensitive drum 61*a* is rotatingly moved in the direction of an arrow a. Reference numeral 62*a* denotes a primary charging assembly as the charging means, and a magnetic brush formed on a 16 mm diameter sleeve is so provided as to be in contact with the surface of the photosensitive drum 61*a*. Reference numeral 67*a* denotes laser light for forming an electrostatic latent image on the photosensitive drum 61*a* whose surface has uniformly been charged by means of the primary charging assembly 62*a,* which is emitted by an exposure means (not shown). Reference numeral 63*a* denotes a developing assembly as a developing means for developing the electrostatic latent image held on the photosensitive drum 61*a,* to form a color toner image, which holds a two-component type developer having a color toner and a carrier. Reference numeral 64*a* denotes a transfer blade as a transfer means for transferring the color toner image formed on the surface of the photosensitive drum 61*a,* to the surface of a transfer medium (recording medium) transported by a beltlike transfer medium carrying member 68. This transfer blade 64*a* comes into touch with the back of the transfer medium carrying member 68 and can apply a transfer bias.

In this first image-forming unit Pa, the photosensitive drum 61*a* is uniformly primarily charged by the primary charging assembly 62*a,* and thereafter the electrostatic latent image is formed on the photosensitive member by the exposure laser light 67*a.* The electrostatic latent image is developed with the color toner of the two-component type developer the developing assembly 63*a* holds. The toner image thus formed by development is transferred to the surface of the transfer medium by applying transfer bias from a transfer bias applying means 60*a* to the transfer blade 64*a* coming into touch with the back of the beltlike transfer medium carrying member 68 carrying and transporting the transfer medium, at a first transfer zone (the position where the photosensitive member and the transfer medium come into contact).

The toner is consumed as a result of the development and the T/C ratio lowers, whereupon this lowering is detected by a toner concentration detecting sensor 85 which measures changes in permeability of the developer by utilizing the inductance of a coil, and a replenishing toner 65*a* is replenished in accordance with the quantity of the toner consumed.

The toner concentration detecting sensor 85 has a coil (not shown) on its inside.

In the image-forming apparatus, the second image-forming unit Pb, third image-forming unit Pc and fourth image-forming unit Pd, constituted in the same way as the first image-forming unit Pa but having different color toners held in the developing assemblies, are provided side by side. For example, a yellow toner is used in the first image-forming unit Pa, a magenta toner in the second image-forming unit Pb, a cyan toner in the third image-forming unit Pc and a black toner in the fourth image-forming unit Pd, and the respective color toners are successively transferred to the transfer medium at the transfer zones of the respective image-forming units. In this course, the respective color toners are superimposed while making registration, on the same transfer medium during one-time movement of the transfer medium. After the transfer is completed, the transfer medium is separated from the surface of the transfer medium carrying member 68 by a separation charging assembly 69, and then sent to a fixing assembly 70 by a transport means such as a transport belt, where a final full-color image is formed by only-one-time fixing.

The fixing assembly 70 has a 40 mm diameter fixing roller 71 and a 30 mm diameter pressure roller 72 in pair. The fixing roller 71 has heating means 75 and 76 on its inside.

The unfixed color toner images transferred onto the transfer medium are passed through the pressure contact area between the fixing roller 71 and the pressure roller 72 of this fixing assembly 70, whereupon they are fixed onto the transfer medium by the action of heat and pressure.

In the apparatus shown in FIG. 3, the transfer medium carrying member 68 is an endless beltlike member. This beltlike member is moved in the direction of an arrow e by a drive roller 80. Reference numeral 79 denotes a transfer belt cleaning assembly; 81, a belt follower roller; and 82, a belt charge eliminator. Reference numeral 83 denotes a pair of resist rollers for transporting to the transfer medium carrying member 68 the transfer medium kept in a transfer medium holder.

As the transfer means, the transfer blade coming into touch with the back of the transfer medium carrying member may be replaced with a contact transfer means that comes into contact with the back of the transfer medium carrying member and can directly apply a transfer bias, as exemplified by a roller type transfer roller.

The above contact transfer means may also be replaced with a non-contact transfer means that performs transfer by applying a transfer bias from a corona charging assembly provided in non-contact with the back of the transfer medium carrying member, as commonly used.

However, in view of the advantage that the quantity of ozone generated when the transfer bias is applied can be controlled, it is more preferable to use the contact transfer means.

An example of another image-forming method of the present invention will be described below with reference to FIG. 4.

Figure 4:
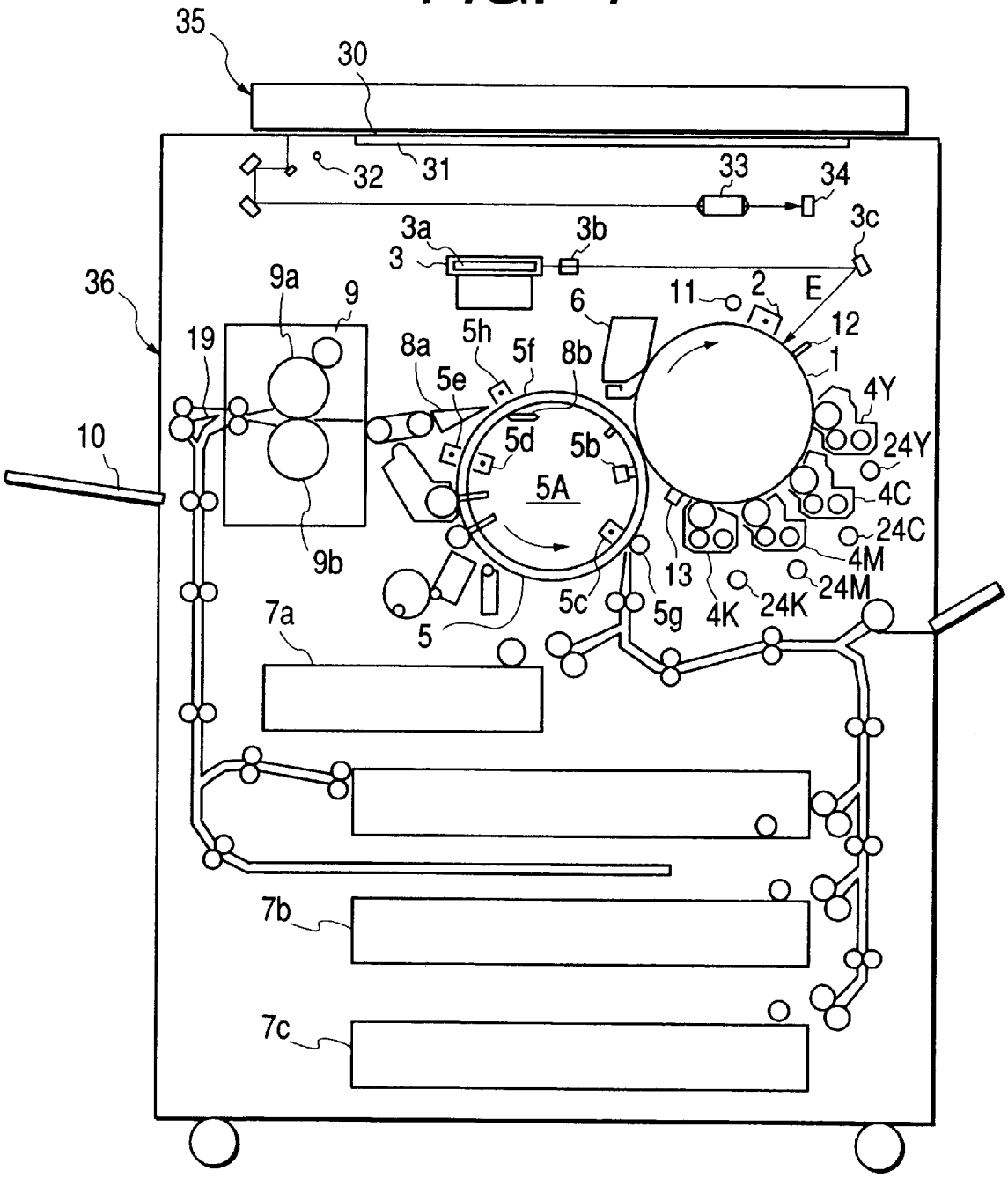
FIG. 4 is a schematic illustration of another example of an image forming apparatus used to carry out the image forming method according to the present invention.

FIG. 4 schematically illustrates the construction of an example of an image-forming apparatus which can carry out the image-forming method of the present invention.

This image-forming apparatus is set up as a full-color copying machine. The full-color copying machine has, as shown in FIG. 4, a digital color-image reader section 35 at the top and a digital color-image printer section 36 at a lower part.

In the image reader section, an original 30 is placed on an original-setting glass 31, and an exposure lamp 32 is put into exposure scanning, whereby an optical image reflected from the original 30 is focused on a full-color sensor 34 through a lens 33 to obtain color separation image signals. The color separation image signals are processed by a video processing unit (not shown) through an amplifying circuit (not shown), and then forwarded to the digital color-image printer section.

In the image printer section, a photosensitive drum 1 as an electrostatic latent image bearing member is a photosensitive member formed of, e.g., an organic photoconductor, and is supported rotatably in the direction of an arrow. Around the photosensitive drum 1, a pre-exposure lamp 11, a corona charging assembly 2 as a primary charging assembly, a laser exposure optical system 3 as a latent-image-forming means, a potential sensor 12, four different color developing assemblies 4Y, 4C, 4M and 4K, a detecting means 13 for detecting the amount of light on the drum, a transfer member 5A and a cleaning assembly 6 are provided.

In the laser exposure optical system 3, the image signals sent from the reader section are converted into optical signals for image scanning exposure in a laser output section (not shown). The laser light thus converted is reflected on a polygonal mirror 3*a* and projected on the surface of the photosensitive drum 1 through a lens 3*b* and a mirror 3*c*.

In the printer section, the photosensitive drum 1 is rotated in the direction of an arrow at the time of image formation. The photosensitive drum 1 is, after destaticized by the pre-exposure lamp 11, uniformly negatively charged by means of the charging assembly 2, and then irradiated with an optical image E for each separated color to form an electrostatic latent image on the photosensitive drum 1.

Next, a stated developing assembly is operated to develop the electrostatic latent image formed on the photosensitive drum 1 to form on the photosensitive drum 1 a visible image formed of a negatively chargeable toner comprised basically of resin, i.e., a toner image. The developing assemblies 4Y, 4C, 4M and 4K are brought to alternatingly come close to the photosensitive drum 1 in accordance with the respective separated colors by the operation of eccentric cams 24Y, 24C, 24M and 24K, respectively, to perform development.

The transfer apparatus 5A has a transfer drum 5, a transfer charging assembly 5*b*, an attraction charging assembly 5*c* for electrostatically attracting a recording medium, and an attraction roller 5*g* provided opposingly to the assembly 5*c*, and also has an inside charging assembly 5*d*, an outside charging assembly 5*e* and a separation charging assembly 5*h*. The transfer drum 5 is supported on a shaft so that it can be rotatably driven, and has a transfer sheet 5*f* serving as a recording medium holding member that holds the recording medium (transfer medium) at an open zone on the periphery thereof, the transfer sheet being provided in a cylindrical form under integral adjustment. As the transfer sheet 5*f*, polycarbonate film is used.

The recording medium is transported from a cassette 7*a*, 7*b* or 7*c* to the transfer drum 5 through a transfer sheet transport system, and is held on its transfer sheet 5*f*. With the rotation of the transfer drum 5, the recording medium held on the transfer drum is repeatedly transported to the transfer position facing the photosensitive drum 1. In the course where it passes the transfer position, the toner image formed on the photosensitive drum 1 is transferred to the recording medium by the action of the transfer charging assembly 5*b*.

The above steps of image formation are repeatedly carried out on yellow (Y), cyan (C), magenta (M) and black (K), thus a color toner image formed by superimposingly transferring four color toner images is obtained on the recording medium held on the transfer drum 5.

In the case of one-side image formation, the recording medium to which the four color toner images have been thus transferred is separated from the transfer drum 5 by the action of a separation claw 8*a,* a separation push-up roller 8*b* and the separation charging assembly 5*h,* and is sent to a heat fixing assembly 9. This heat fixing assembly 9 is constituted of a heat fixing roller 9*a* having a heating means internally, and a pressure roller 9*b.* The recording medium is passed through the pressure contact area between the heat fixing roller 9*a* and the pressure roller 9*b,* serving as a heating member. Thus, the full color toner image supported on the recording medium is fixed to the recording medium. That is, by this fixing step the color mixing of the toners, color formation, and fixing to the recording medium are carried out until a full-color permanent image is formed. Thereafter, the recording medium having the image thus formed is outputted to a tray 10. Thus, the full-color copying on one sheet is completed. Meanwhile, the photosensitive drum 1 is cleaned by the cleaning assembly 6 so that toners remaining on its surface are removed, and thereafter again put to the steps of image formation.

In the image-forming method of the present invention, the toner image formed by developing the electrostatic latent image formed on the electrostatic latent image bearing member may be transferred to the recording medium via an intermediate transfer member.

More specifically, such an image-forming method has the step of transferring to an intermediate transfer member the toner formed by developing the electrostatic latent image formed on the electrostatic latent image bearing member, and the step of transferring to a recording medium the toner image transferred to the intermediate transfer member.

An example of the image-forming method employing the intermediate transfer member will specifically be described below with reference to FIG. 5.

Figure 5:
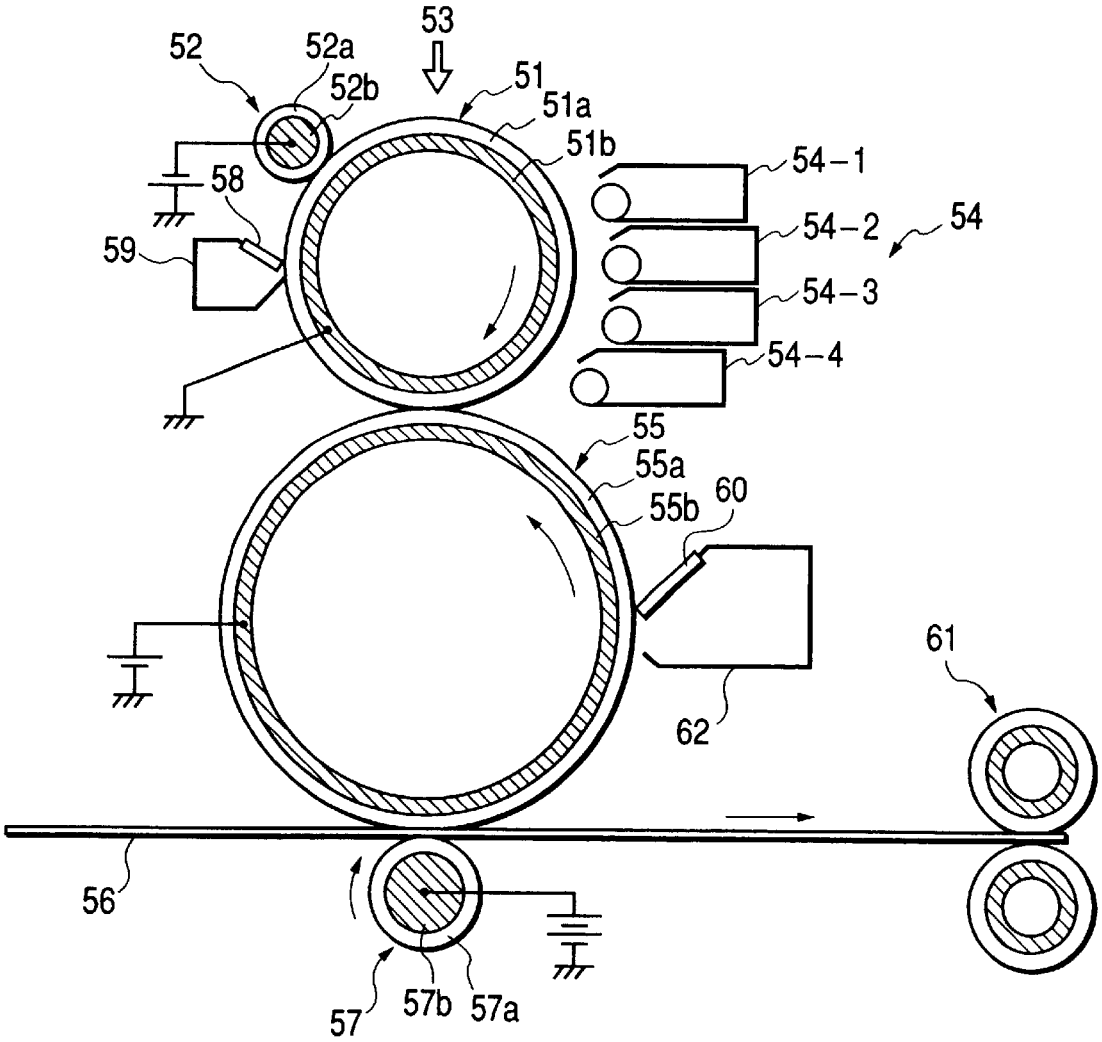
FIG. 5 is a schematic illustration of still another example of an image forming apparatus used to carry out the image forming method according to the present invention.

In the apparatus system shown in FIG. 5, a cyan developer having a cyan toner, a magenta developer having a magenta toner, a yellow developer having a yellow toner and a black developer having a black toner are put into cyan, magenta, yellow and black developing assemblies 54-1, 54-2, 54-3 and 54-4, respectively. An electrostatic latent image is formed on a photosensitive member 51 serving as the electrostatic latent image bearing member, by an electrostatic latent image-forming means 53 such as laser light. The electrostatic latent image formed on the photos sensitive member 51 is developed by magnetic brush development, non-magnetic one-component development or magnetic jumping development to form toner images of respective colors on the photosensitive member 51. The photosensitive member 51 may be a photosensitive drum or photosensitive belt having a photoconductive insulating material layer 51*a* formed of amorphous selenium, cadmium sulfide, zinc oxide, an organic photoconductor or amorphous silicon. The photosensitive member 51 is rotated in the direction of an arrow by means of a drive mechanism (not shown). As the photosensitive member 51, a photosensitive member having an amorphous silicon photosensitive layer or organic photosensitive layer is preferably used.

The organic photosensitive layer may be of either of a single-layer type in which a charge-generating material and a charge-transporting material are contained in the same layer, and a function-separated photosensitive layer formed of a charge transport layer and a charge generation layer. A multi-layer type photosensitive layer comprising a conductive support and superposingly formed thereon the charge generation layer and the charge transport layer in this order is one of preferred examples.

As binder resins for the organic photosensitive layer, polycarbonate resins, polyester resins or acrylic resins have a very good cleaning performance, and may hardly cause faulty cleaning and melt-adhesion of toner or filming of external additives to the photosensitive member.

The step of charging has a system making use of a corona charging assembly and being in non-contact with the photosensitive member 51 or a contact type system making use of a contact charging member such as a charging roller. Either system may be used. The contact charging system as shown in FIG. 5 is preferably used so as to enable efficient and uniform charging, simplify the system and make ozone less occur.

A charging roller 52 as a primary charging member is basically constituted of a mandrel 52*b* at the center and a conductive elastic layer 52*a* that forms the periphery. The charging roller 52 is brought into pressure contact with the surface of the photosensitive member 51 under a pressure, and is rotated in follow-up with the rotation of the photosensitive member 51.

When the charging roller is used, preferable process conditions are as follows: Contact pressure of the charging roller is 4.9 to 490 N/m (5 to 500 g/cm); and, when a voltage formed by superimposing an AC voltage on a DC voltage, AC voltage is 0.5 to 5 kVpp, AC frequency is 50 Hz to 5 kHz and DC voltage is ±0.2 to ±5 kV.

As other contact charging members, a method making use of a charging blade and a method making use of a conductive brush are available. These contact charging members have the advantages that no high voltage is required and ozone less occurs.

The charging roller or charging blade serving as the contact charging members may preferably be made of conductive rubber, and a release coating may be provided on its surface. To form the release coating, it is possible to use nylon resins, PVDF (polyvinylidene fluoride), PVDC (polyvinylidene chloride) and fluorine acrylic resins.

The toner image formed on the photosensitive member 51 is transferred to an intermediate transfer member 55 to which a voltage (e.g., ±0.1 to ±5 kV) is kept applied. The intermediate transfer member 55 is constituted of a pipelike conductive mandrel 55*b* and a medium-resistance elastic layer 55*a* formed on its periphery. The mandrel 55*b* may have a plastic surface provided thereon with a conductive layer (e.g., a conductive coating).

The medium-resistance elastic layer 55*a* is a solid or foamed-material layer made of an elastic material such as silicone rubber, Teflon rubber, chloroprene rubber, urethane rubber or EPDM (ethylene-propylene-diene terpolymer) in which a conductivity-providing agent such as carbon black, zinc oxide, tin oxide or silicon carbide has been mixed and dispersed to adjust electrical resistance (volume resistivity) to a medium resistance of from $10^5$ to $10^{11}$ Ω·cm.

The intermediate transfer member 55 is axially supported in parallel to the photosensitive member 51 so as to be provided in contact with the underside of the photosensitive member 51, and is counterclockwise rotated in the direction of an arrow at the same peripheral speed as that of the photosensitive member 51.

In the course where a first-color toner image formed on the surface of the photosensitive member 51 is passed through the transfer nip at which the photosensitive member 51 and the intermediate transfer member 55 come into contact, the toner image is transferred orderly onto the periphery of the intermediate transfer member 55 by the aid of an electric field formed at the transfer nip region by a transfer bias applied to the intermediate transfer member 55.

Transfer residual toner remaining on the photosensitive member 51 without being transferred to the intermediate transfer member 55 is removed by a photosensitive member cleaning member 58 and collected in a cleaning container 59 for the photosensitive member 51.

A transfer means 57 is axially supported in parallel to the intermediate transfer member 55 so as to be provided in contact with the underside of the intermediate transfer member 55. The transfer means 57 is, e.g., a transfer roller or a transfer belt, which is clockwise rotated in the direction of an arrow at the same peripheral speed as that of the intermediate transfer member 55. The transfer means 57 may be provided in the manner that it comes in direct contact with the intermediate transfer member 55, or in the manner that it comes in indirect contact with the latter via a transfer belt provided between the intermediate transfer member 55 and the transfer means 57.

In the case of the transfer roller, it is basically constituted of a mandrel 57*b* at the center and a conductive elastic layer 57*a* that forms the periphery.

To form the intermediate transfer member and transfer roller, materials commonly available may be used. The volume resistivity of the elastic layer of the transfer roller may be set smaller than the volume resistivity of the elastic layer of the intermediate transfer member, whereby the voltage applied to the transfer roller can be made lower. Thus, good toner images can be formed on the transfer medium and at the same time the transfer medium can be prevented from winding around the intermediate transfer member. In particular, what is preferred is that the elastic layer of the intermediate transfer member has a volume resistivity at least 10 times higher than the elastic layer of the transfer roller.

Hardness of the intermediate transfer member and transfer roller is measured according to JIS K-6301. The intermediate transfer member used in the present invention may preferably be formed of an elastic layer having a hardness in the range of from 10 to 40 degrees. As for the elastic layer of the transfer roller, it may preferably have a hardness greater than the hardness of the elastic layer of the intermediate transfer member and has the value of from 41 to 80 degrees in order to prevent the transfer medium from winding around the intermediate transfer member. If inversely the hardness is greater in the intermediate transfer member than in the transfer roller, a concave is formed on the side of the transfer roller, so that the transfer medium tends to wind around the intermediate transfer member.

The transfer means 57 is rotated at a peripheral speed equal to, or different from, the peripheral speed of the intermediate transfer member 55. The transfer medium 56 is transported to the part between the intermediate transfer member 55 and the transfer means 57, and at the same time a bias with a polarity reverse to that of triboelectric charges possessed by the toner is applied to the transfer means 57 from a transfer bias applying means, so that the toner images on the intermediate transfer member 55 is transferred to the surface of the transfer medium 56.

Transfer residual toner remaining on the intermediate transfer member without being transferred to the transfer medium 56 is removed by an intermediate transfer member cleaning member 60 and is collected in a cleaning container 62 for the intermediate transfer member. The toner image transferred to the transfer medium 56 is fixed to the transfer medium 56 by means of a heat fixing assembly 61.

The transfer roller may also be made of the same material as the charging roller. Preferable transfer process conditions are as follows: Contact pressure of the transfer roller is 2.94 to 490 N/m (3 to 500 g/cm), and more preferably 19.6 N/m to 294 N/m, and DC voltage is ±0.2 to ±10 kV.

If the linear pressure as the contact pressure is 2.94 N/m or below, transport aberration of transfer mediums and faulty transfer tends to occur undesirably.

The conductive elastic layer 57*a* of the transfer roller 57 is, e.g., a solid or foamed-material layer made of an elastic material such as polyurethane rubber of EPDM (ethylene-propyleneimine terpolymer) in which a conductivity-providing agent such as carbon black, zinc oxide, tin oxide or silicon carbide has been mixed and dispersed to adjust electrical resistance (volume resistivity) to a medium resistance of from $10^6$ to $10^{10}$ Ω·cm.

According to the present invention, the water absorption per unit area of the coated carrier is controlled within the specific range. Thus, the toner can have a stable charging performance without dependence on environment, and good image quality can be attained over a long period of time.

EXAMPLES

The present invention will be described below by specifically giving Examples. The present invention is by no means limited to these.

Carrier Production Example 1

| | (by weight) |
|---|---|
| Phenol | 7.5 parts |
| Formalin solution (formaldehyde: about 40%; methanol: about 10%; the remainder: water) | 11.25 parts |
| Fine magnetite particles lipophilic-treated with 1.0% by weight of γ-glycidoxypropyltrimethoxysilane (average particle diameter: 0.24 μm; specific resistance: $5 \times 10^5$ Ω · cm) | 53 parts |
| Fine α-$Fe_2O_3$ particles lipophilic-treated with 1.0% by weight of γ-glycidoxypropyltrimethoxysilane (average particle diameter: 0.60 μm; specific resistance: $2 \times 10^9$ Ω · cm) | 35 parts |

The lipophilic treatment of magnetite particles and hematite α-$Fe_2O_3$ particles was made by adding 1.0 part by weight of γ-glycidoxypropyltrimethoxysilane to 99 parts by weight each of magnetite particles and α-$Fe_2O_3$ particles, followed by premixing and stirring at 100° C. for 30 minutes in a Henschel mixer.

The above materials and 11 parts by weight of water were mixed for 1 hour while keeping them at 40° C. The slurry obtained was put into a flask, and 2.0 parts by weight of a basic catalyst aqueous 28% by weight ammonia and 11 parts by weight of water were added thereto. Temperature was raised to 85° C. in 40 minutes while mixing and stirring them and was kept at that temperature, where the polymerization reaction was carried out for 3 hours to form a phenolic resin, followed by curing. Thereafter, the reaction mixture was cooled to 30° C., and 100 parts by weight of water was added thereto. Then, the supernatant formed was removed, and the precipitate was washed with water, followed by air drying. Subsequently, the air-dried product was further dried at 180° C. under reduced pressure (5 mmHg or below), to obtain spherical magnetic carrier core particles containing fine magnetite particles dispersedly, comprised of the phenolic resin as a binder resin.

The particles thus obtained were put through sieves of 60 meshes and 100 meshes to remove coarse particles, and then fine powder and coarse powder were removed by means of a multi-division air classifier (ELBOW JET LABO EJ-L-3, manufactured by Nittetsu Kogyo K.K.) utilizing the Coanda effect to obtain carrier core particles having a volume-average 50% particle diameter of 35 μm. The carrier core particles obtained had a volume resistivity of $2.2\times10^{12}$ Ω·cm and a water content of 0.15% by weight.

The carrier core particles thus obtained were introduced into a coater, and moistened nitrogen was flowed into it to adjust their water content to 0.3% by weight before coating. Thereafter, 3% by weight of γ-aminopropyltrimethoxysilane diluted with a toluene solvent was added as a primer to treat the core surfaces while applying a shear stress continuously. Also, this treatment was made while causing the solvent to evaporate at 40° C. and 100 Torr in a stream of dry nitrogen. Subsequently, the cores thus treated was coated with a mixture of 0.5% by weight of a coating material straight silicone resin whose substituents were all methyl groups (hereinafter "methylsilicone") and 0.015% by weight of a coupling agent γ-aminopropyltrimethoxysilane (hereinafter "aminosilane") using toluene as a solvent. This coating treatment was carried out while causing the solvent to evaporate at 40° C. and 500 Torr in a stream of dry nitrogen.

The resultant magnetic coated carrier was further baked at 140° C., and agglomerate coarse particles were removed through a sieve of 100 meshes, and then fine powder and coarse powder were removed by means of the multi-division air classifier to adjust particle size distribution.

Thereafter, the resultant classified carrier was moisture-conditioned for 100 hours in a hopper kept at 23° C. and 60% RH to obtain magnetic coated carrier No. 1. Production conditions of the magnetic coated carrier No. 1 thus obtained are summarized in Table 1, and its physical properties are shown in Table 2.

Carrier Production Example 2

Magnetic coated carrier No. 2 was obtained in the same manner as in Carrier Production Example 1 except that the proportion of the magnetite particles and hematite particles used therein was changed to 70:30. Production conditions of the magnetic coated carrier No. 2 thus obtained are summarized in Table 1, and its physical properties are shown in Table 2.

Carrier Production Example 3

In Carrier Production Example 1, the proportion of the magnetite particles and hematite particles was changed to 100:0 and the carrier core particles were produced using magnetite particles lipophilic-treated with γ-aminopropyltrimethoxysilane. Thereafter, magnetic coated carrier No. 3 was obtained in the same manner as in Carrier Production Example 1 except that the moistened nitrogen was flowed to adjust cores' pre-coating water content to 0.49% by weight and the coating treatment of the cores having been primer-treated with the aminosilane was replaced with coating treatment with a mixture of 1.5% by weight of methylsilicone and 0.045% by weight of aminosilane. Production conditions of the magnetic coated carrier No. 3 thus obtained are summarized in Table 1, and its physical properties are shown in Table 2.

Carrier Production Example 4

In Carrier Production Example 1, the proportion of the magnetite particles and hematite particles was changed to 40:60 to produce the carrier core particles. Thereafter, magnetic coated carrier No. 4 was obtained in the same manner as in Carrier Production Example 1 except that the cores' pre-coating water content was adjusted to 0.03% by weight under reduced pressure of 100 Torr and the coating treatment of the cores having been primer-treated with the aminosilane was replaced with coating treatment with 3% by weight of styrene-tetrafluoroethylene copolymer. Production conditions of the magnetic coated carrier No. 4 thus obtained are summarized in Table 1, and its physical properties are shown in Table 2.

Carrier Production Example 5

Magnetic coated carrier No. 5 was obtained in the same manner as in Carrier Production Example 2 except that the carrier core particles were produced using melamine resin as the binder resin. Production conditions of the magnetic coated carrier No. 5 thus obtained are summarized in Table 1, and its physical properties are shown in Table 2.

Carrier Production Example 6

Magnetic coated carrier No. 6 was obtained in the same manner as in Carrier Production Example 3 except that epoxy resin was used as the binder resin, the catalyst ammonia was not added at the time of core polymerization, the cores' pre-coating water content was adjusted to 0.52% by weight, thereafter the primer treatment was made with aminosilane but in an amount of 0.5% by weight and also the coating treatment was made with 0.5% by weight of polyester resin. Production conditions of the magnetic coated carrier No. 6 thus obtained are summarized in Table 1, and its physical properties are shown in Table 2.

Carrier Production Example 7

Magnetic coated carrier No. 7 was obtained in the same manner as in Carrier Production Example 2 except that the magnetite particles and hematite particles were lipophilic-treated with n-propyltrimethoxysilane and the cores' pre-coating water content was adjusted to 0.48% by weight. Production conditions of the magnetic coated carrier No. 7 thus obtained are summarized in Table 1, and its physical properties are shown in Table 2.

Carrier Production Example 8

Magnetic coated carrier No. 8 was obtained in the same manner as in Carrier Production Example 2 except that the cores' pre-coating water content was adjusted to 0.12% by weight and the coating treatment with methylsilicone and aminosilane was made in the same manner as in Carrier Production Example 3. Production conditions of the magnetic coated carrier No. 8 thus obtained are summarized in Table 1, and its physical properties are shown in Table 2.

Carrier Production Example 9

Magnetic coated carrier No. 9 was obtained in the same manner as in Carrier Production Example 2 except that the magnetite particles and hematite particles were lipophilic-treated with the same aminosilane as in Carrier Production Example 3, the cores' pre-coating water content was adjusted to 0.50% by weight and thereafter the coating treatment was changed to coating under normal pressure (760 Torr) and without flowing the dry nitrogen. Production conditions of the magnetic coated carrier No. 9 thus obtained are summarized in Table 1, and its physical properties are shown in Table 2.

Carrier Production Example 10

Magnetic coated carrier No. 10 was obtained in the same manner as in Carrier Production Example 2 except that the catalyst at the time of core polymerization was replaced with sodium hydroxide and the cores' pre-coating water content was adjusted to 0.47% by weight. Production conditions of the magnetic coated carrier No. 10 thus obtained are summarized in Table 1, and its physical properties are shown in Table 2.

Carrier Production Example 11

Magnetic coated carrier No. 11 was obtained in the same manner as in Carrier Production Example 2 except that the cores' pre-coating water content was adjusted to 0.46% by weight. Production conditions of the magnetic coated carrier No. 11 thus obtained are summarized in Table 1, and its physical properties are shown in Table 2.

Carrier Production Example 12

In Carrier Production Example 1, the proportion of the magnetite particles and hematite particles was changed to 100:0 and also the carrier core particles were produced using magnetite particles (average particle diameter: 0.15 μm) not lipophilic-treated and using CaF as a suspension stabilizer. Thereafter, magnetic coated carrier No. 12 was obtained in the same manner as in Carrier Production Example 1 except that the moistened nitrogen was flowed to adjust cores' pre-coating water content to 0.50% by weight and only the primer treatment with aminosilane was made in the same manner as in Carrier Production Example 9. Production conditions of the magnetic coated carrier No. 12 thus obtained are summarized in Table 1, and its physical properties are shown in Table 2.

Toner Production Example 1

(Pulverization Toner 1)

| | (by weight) |
|---|---|
| Polyester resin (condensation polymer of propoxylated bisphenol A with fumaric acid; acid value: KOH/g) | 10.8 mg |
| C.I. Pigment Blue 15:3 | 100 parts |
| Aluminum compound of dialkylsalicylic acid | 5 parts |
| Low-molecular-weight polypropylene | 5 parts |
| | 5 parts |

The above materials were mixed using a Henschel mixer, and then melt-kneaded by means of a twin-screw extruder while sucking the kneaded product through a vent port connected to a suction pump. The kneaded product was crushed by means of a hammer mill to obtain 1 mm mesh-pass crushed product. The crushed product was further finely pulverized by means of a jet mill, followed by classification by means of a multi-division classifier (Elbow Jet) to obtain cyan toner particles.

In 100 parts by weight of the cyan toner particles thus obtained, 1.2 parts by weight of hydrophobic-treated fine titanium oxide powder (number-average particle diameter of primary particles: 0.02 μm) was mixed using a Henschel mixer to obtain a cyan toner, toner No. 1, having a weight-average particle diameter of 6.5 μm. Composition and physical properties of the toner No. 1 obtained are shown in Table 3.

Toner Production Example 2

(Pulverization Toner 2)

Cyan toner No. 2 was obtained in the same manner as in Toner Production Example 1 except that the polyester resin used therein was replaced with 100 parts by weight of styrene/n-butyl acrylate copolymer resin (acid value: 0 mg KOH/g; Mw: 30,000; Mn: 9,000) and, in 100 parts by weight of the cyan toner particles thus obtained, 1.2 parts by weight of hydrophobic-treated fine silica powder (number-average particle diameter of primary particles: 0.03 μm) was mixed using a Henschel mixer. Composition and physical properties of the toner No. 2 obtained are shown in Table 3.

Toner Production Example 3

(Pulverization Toner 3)

Cyan toner No. 3 was obtained in the same manner as in Toner Production Example 1 except that the aluminum compound of dialkylsalicylic acid was not added. Composition and physical properties of the toner No. 3 obtained are shown in Table 3.

Toner Production Example 4

(Pulverization Toner 4)

Cyan toner No. 4 was obtained in the same manner as in Toner Production Example 1 except that the aluminum compound of dialkylsalicylic acid was replaced with carixarene. Composition and physical properties of the toner No. 4 obtained are shown in Table 3.

Toner Production Example 5

(Pulverization Toner 5)

A cyan toner, toner No. 5, having a weight-average particle diameter of 11.3 μm was obtained in the same manner as in Toner Production Example 1 except that conditions used therein for the pulverization of kneaded product and the classification were changed. Composition and physical properties of the toner No. 5 obtained are shown in Table 3.

Toner Production Example 6

(Polymerization Toner 6)

Into 710 parts by weight of ion-exchanged water, 450 parts by weight of an aqueous 0.1M $Na_3PO_4$ solution was introduced. The mixture formed was heated to 60° C., and thereafter stirred at 12,000 rpm by means of a TK-type homomixer (manufactured by Tokushukika Kogyo K.K.). Then, 68 parts by weight of an aqueous 1.0M $CaCl_2$ solution was slowly added thereto to obtain an aqueous medium containing calcium phosphate $Ca_3(PO_4)_2$.

| | (by weight) |
|---|---|
| Styrene | 165 parts |
| n-Butyl acrylate | 35 parts |
| C.I. Pigment Blue 15:3 (colorant) | 15 parts |
| Dialkylsalicylic acid metal compound (charge control agent) | 5 parts |
| Saturated polyester resin (polar resin) | 10 parts |
| Ester wax (melting point: 70° C.) | 50 parts |

Meanwhile, the above materials were heated to 60° C. and were uniformly dissolved or dispersed at 11,000 rpm by means of a TK-type homomixer (manufactured by Tokushukika Kogyo K.K.). To the dispersion obtained, 10 parts by weight of a polymerization initiator 2,2'-azobis(2,4-dimethylvaleronitrile) to prepare a polymerizable monomer composition.

The polymerizable monomer composition was introduced into the above aqueous medium and then stirred at 11,000 rpm for 10 minutes by means of the TK-type homomixer at 60° C. in an atmosphere of $N_2$ to granulate the polymerizable monomer composition. Thereafter, with stirring using paddle stirring blades, the temperature was raised to 80° C. to carry out the reaction for 10 hours. After the polymerization reaction was completed, residual monomers were evaporated off under reduced pressure and the reaction mixture was cooled. Thereafter, hydrochloric acid was added to dissolve the calcium phosphate, followed by filtration, water washing and drying to obtain cyan toner particles.

To 100 parts by weight of the cyan toner particles thus obtained, 1.6 parts by weight of hydrophobic-treated fine silica powder (number-average particle diameter of primary particles: 0.03 μm) was externally added to obtain a cyan toner, toner No. 6, having a weight-average particle diameter of 6.8 μm. Composition and physical properties of the toner No. 6 obtained are shown in Table 3.

Toner Production Example 7

(Polymerization Toner 7)

A cyan toner, toner No. 7, was obtained in the same manner as in Toner Production Example 6 except that the hydrophobic-treated fine silica powder used therein was replaced with 1.2 parts by weight of hydrophobic-treated fine alumina powder (number-average particle diameter of primary particles: 0.1 μm). Composition and physical properties of the toner No. 7 obtained are shown in Table 3.

Toner Production Example 8

(Polymerization Toner 8)

A magenta toner, toner No. 8, was obtained in the same manner as in Toner Production Example 6 except that C.I. Pigment Blue 15:3 used therein was replaced with 8 parts by weight of quinacridone. Composition and physical properties of the toner No. 8 obtained are shown in Table 3.

Toner Production Example 9

(Polymerization Toner 9)

A yellow toner, toner No. 9, was obtained in the same manner as in Toner Production Example 6 except that C.I. Pigment Blue 15:3 used therein was replaced with 6.5 parts by weight of Pigment Yellow 93. Composition and physical properties of the toner No. 9 obtained are shown in Table 3.

Toner Production Example 10

(Polymerization Toner 10)

A black toner, toner No. 10, was obtained in the same manner as in Toner Production Example 6 except that C.I. Pigment Blue 15:3 used therein was replaced with 10 parts by weight of carbon black. Composition and physical properties of the toner No. 10 obtained are shown in Table 3.

Example 1

The carrier No. 1 and the toner No. 6 were so blended that the toner was in a proportion of 8% by weight based on the total weight to produce two-component type developer A.

The two-component type developer A thus obtained was used in an image-forming apparatus which is a remodeled machine of a commercially available copying machine GP55 (manufactured by CANON INC.) to reproduce images, and evaluation was made on transfer efficiency, charging rise performance, charging stability, toner scatter, fog and image density. Measurement conditions and evaluation criteria for these are shown below.

As to evaluation environment, the evaluation was made in environments of normal temperature and low humidity (N/L; 23° C./5% RH), normal temperature and normal humidity (N/N; 23° C./60% RH) and high temperature and high humidity (H/H; 30° C./80% RH).

With regard to the transfer efficiency, it was evaluated in the environment of normal temperature and normal humidity. Evaluation was made in the following way: First, a solid black toner image was formed on the photosensitive drum. This solid black image was collected with a transparent pressure-sensitive adhesive tape, and its image density (D1) was measured with a color reflection densitometer X-RITE 404A, manufactured by X-Rite Co.). Next, a solid black toner image was again formed on the photosensitive drum and then transferred onto a recording medium, where the solid black toner image transferred onto the recording medium was collected with a transparent pressure-sensitive adhesive tape, and its image density (D2) was measured. From the image densities (D1) and (D2) thus measured, the transfer efficiency was calculated according to the following expression.

$$\text{Transfer efficiency } (\%) = (D2/D1) \times 100$$

With regard to the charging rise performance, a 1,000-sheet copying test was made in the environment of normal temperature and low humidity, and the charging rise performance was evaluated by changes in charge quantity of the developer from the initial stage. To make the evaluation, the copying machine was made to idle for 2 minutes and thereafter image reproduction was started, and the width of change between charge quantity at the start and charge quantity at 1,000th sheet copying was expressed by percentage (%). Evaluation was made according to the following criteria.

(Evaluation Criteria)

A: The width of change in charge quantity is less than 2%.

B: The width of change in charge quantity is 2% to less than 6%.

C: The width of change in charge quantity is 6% to less than 10%.

D: The width of change in charge quantity is 10% to less than 15%.

E: The width of change in charge quantity is 15% to less than 20%.

F: The width of change in charge quantity is 20% or more.

With regard to the charging stability, a 50,000-sheet copying test was made in the environment of high temperature and high humidity, and the charging stability was evaluated by changes in charge quantity of the developer from the initial stage. To make the evaluation, the width of change between charge quantity at the 1,000th sheet copying and charge quantity at the time the test was completed was expressed by percentage (%). Evaluation was made according to the following criteria.

(Evaluation Criteria)

A: The width of change in charge quantity is 0% to less than 11%.

B: The width of change in charge quantity is 11% to less than 20%.

C: The width of change in charge quantity is 20% to less than 30%.

D: The width of change in charge quantity is 30% to less than 40%.

E: The width of change in charge quantity is 40% to less than 50%.

F: The width of change in charge quantity is 50% or more.

With regard to the toner scatter, the developing assembly was taken out after the 50,000-sheet image reproduction made in the environment of high temperature and high humidity, and was set in an idling machine. A4-size paper was placed with its center just beneath the sleeve of the developing assembly and the machine was made to idle for 10 minutes, where the weight of any toner having fallen on the paper was measured to make evaluation according to the following criteria.

(Evaluation Criteria)

A: Less than 4 mg.
B: 4 mg to less than 7 mg.
C: 7 mg to less than 10 mg.
D: 10 mg to less than 13 mg.
E: 13 mg to less than 16 mg.
F: 16 mg or more.

With regard to the fog, the reflection density of virgin white paper and the reflection density of non-image areas of paper having passed through the copying machine were measured with a reflection densitometer TC6MC (manufactured by Tokyo Denshoku Technical Center Co.) in the environment of high temperature and high humidity. The difference in reflection density between the both was evaluated on the basis of the reflection density of virgin white paper.

(Evaluation Criteria)

A: Less than 0.6%.
B: 0.6% to less than 1.1%.
C: 1.1% to less than 1.6%.
D: 1.6% to less than 2.1%.
E: 2.1% to less than 4.1%.
F: 4.1% or more.

With regard to the image density, in the environment of high temperature and high humidity, a solid black image was copied at the initial stage and after a 30,000-sheet copying was completed. Their densities were measured with a color reflection densitometer X-RITE 404A, manufactured by X-Rite Co. Results of the evaluation are shown in Table 4.

Examples 2 to 15 & Comparative Examples 1 to 3

Two-component type developers B to R were produced in the same manner as in Example 1 except that the combination of the carrier and toner was changed as shown in Table 4. Images were reproduced to make evaluation similarly. The results of evaluation are shown in Table 4.

Example 16

The carrier No. 1 and the toner No. 6 were so blended that the toner was in a proportion of 8% by weight based on the total weight to produce two-component type developer A.

The toner No. 6 was replaced with the toner No. 8, the toner No. 9 and the toner No. 10 to produce two-component type developers S, T and U, respectively.

The four color, two-component type developers T, S, A and U (actual color order of E-27) were introduced in the developing assemblies 63*a,* 63*b,* 63*c* and 63*d,* respectively, of the full-color image-forming apparatus shown in FIG. 3, and full-color images were formed under conditions shown below. As a result, good full-color images were obtainable, and full-color images with a stable image density were obtainable also in many-sheet copying.

Image-forming conditions:

In the step of charging, the following was used as the magnetic particles 23 used in the magnetic brush charging assembly to charge the OPC (organic photoconductor) photosensitive drum.

Preparation of magnetic particles:

5 parts by weight of MgO, 8 parts by weight of MnO, 4 parts by weight of SrO and 83 parts by weight of $Fe_2O_3$ were each made into fine particles, and then water was added and mixed therein to effect granulation. Thereafter, the granulated product was fired at 1,300° C. to obtain, after adjustment of particle size, magnetic ferrite particles having an average particle diameter of 28 $\mu$m [magnetization intensity: 60 $Am^2/kg$ as measured under application of a magnetic field of 79.58 kA/m (1,000 oersteds); coercive force: $4.38\times10^{-1}$ kA/m (55 oersteds)].

100 parts by weight of the above magnetic ferrite particles were surface-treated with 10 parts by weight of isopropoxytriisostearoyl titanate mixed in a mixed solvent of 99 parts by weight of hexane and 1 part by weight of water, the treatment being so made as to be in an amount of 0.1 part by weight, to obtain magnetic particles.

The magnetic particles thus obtained had a volume resistivity of $3\times10^7$ Ω·cm.

Each charging assembly was set to rotate in the counter direction to the photosensitive drum at a peripheral speed of 120% with respect to the peripheral speed of the photosensitive drum, and DC/AC electric fields (−700 V, 1 kHz/1.2 kvpp) were superimposingly applied to charge the photosensitive drum. An original image with an image area of 30% was digital-processed and digital latent images were formed as electrostatic latent images on the OPC photosensitive drums.

Figure 2:
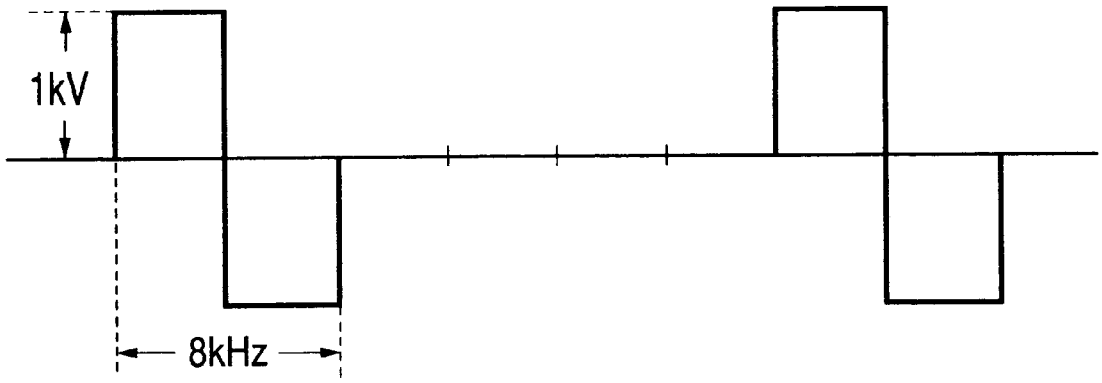
FIG. 2 illustrates an alternating electric field used in Examples.

As the developing assemblies 63*a,* 63*b,* 63*c* and 63*d,* the developing assembly 4 shown in FIG. 1 was used for each. The electrostatic latent images were developed by reverse development by the use of the negatively chargeable color toners. As the development bias applied to each developing sleeve, DC/AC voltages (−300 V, 8 kHz/2 kvpp) making use of a discontinuous alternating bias voltage as shown in FIG. 2 were superimposingly applied, and development contrast was set at 200 V and defogging reverse contrast at −150 V.

The color toner images formed on the photosensitive drum 61*a* and others are, at the first transfer zone (the position where the photosensitive member and the transfer medium come into contact), transferred to the surface of the transfer medium by applying a transfer electric current of −15 $\mu$A from the transfer bias applying means 60*a,* and further successively multiple-transferred to the transfer medium at the second, third and fourth transfer zones.

In the heat-and-pressure fixing assembly, a roller coated with PFA resin in a layer thickness of 1.2 $\mu$m was used as the heating roller and a roller coated with PFA resin in a layer thickness of 1.2 $\mu$m was used as the pressure roller. The silicone oil application means was detached from the heat-and-pressure fixing assembly to carry out oilless fixing.

Example 17

The four color, two-component type developers T, A, S and U which were produced by Example 16, were introduced in the developing assemblies 4Y, 4C, 4M and 4K, respectively, of the full-color image-forming apparatus shown in FIG. 4. To the developing sleeve, DC/AC voltages (−500 V, 12 kHz/2 kvpp) making use of the discontinuous alternating bias voltage were superimposingly applied, and development contrast was set at 270 V, defogging reverse contrast at −120 V and also transfer electric current at 17 $\mu$A, where full-color images were formed in an oilless fixing mode. As a result, good full-color images were obtainable, and full-color images with a stable image density were obtainable also in many-sheet copying.

Example 18

The four color, two-component type developers A, S, T and U which were produced by Example 16, were introduced in the developing assemblies 54-1, 54-2, 54-3 and 54-4, respectively, of the full-color image-forming apparatus shown in FIG. 5. To the developing sleeve, DC/AC voltages (−350 V, 3 kHz/1.8 kVpp) making use of the discontinuous alternating bias voltage were superimposingly applied, and development contrast was set at 250 V, defogging reverse contrast at −150 V and also transfer electric current at 15 $\mu$A, where full-color images were formed in an oilless fixing mode. As a result, good full-color images were obtainable, and full-color images with a stable image density were obtainable also in many-sheet copying.

TABLE 1

Carrier Production Conditions

| | | Metal compound (core) particles | | | | | |
|---|---|---|---|---|---|---|---|
| No. | Binder resin | Magnetic | Non = magnetic | Lipophilic = treating agent | Magnetic/ nom-magnetic | Polymerization catalyst | Water content before coating (wt. %) |
| 1 | phenol resin | magnetite | hematite | epoxy g. silane | 60/40 | ammonia | 0.30 |
| 2 | phenol resin | magnetite | hematite | epoxy g. silane | 70/30 | ammonia | 0.30 |
| 3 | phenol resin | magnetite | — | amino g. silane | 100/0 | ammonia | 0.49 |
| 4 | phenol resin | magnetite | hematite | epoxy g. silane | 40/60 | ammonia | 0.03 |
| 5 | melamine resin | magnetite | hematite | epoxy g. silane | 70/30 | ammonia | 0.31 |
| 6 | epoxy resin | magnetite | — | amino g. silane | 100/0 | none | 0.52 |
| 7 | phenol resin | magnetite | hematite | alkylalkoxysilane | 70/30 | ammonia | 0.48 |
| 8 | phenol resin | magnetite | hematite | epoxy g. silane | 70/30 | ammonia | 0.12 |
| 9 | phenol resin | magnetite | hematite | amino g. silane | 70/30 | ammonia | 0.50 |
| 10 | phenol resin | magnetite | hematite | epoxy g. silane | 70/30 | NaOH | 0.47 |
| 11 | phenol resin | magnetite | hematite | epoxy g. silane | 70/30 | ammonia | 0.46 |
| 12 | phenol resin | magnetite | — | — | 100/0 | ammonia | 0.50 |

| | Coat layer | | | | | | | |
|---|---|---|---|---|---|---|---|---|
| No. | Primer | Amount (wt. %) | Coating material | Amount (wt. %) | Coupling agent | Amount (wt. %) | Vacuum degree (Torr) | Remarks |
| 1 | aminosilane | 0.3 | methylsilicone | 0.5 | aminosilane | 0.015 | 500 | |
| 2 | aminosilane | 0.3 | methylsilicone | 0.5 | aminosilane | 0.015 | 500 | |
| 3 | aminosilane | 0.3 | methylsilicone | 1.5 | aminosilane | 0.045 | 500 | |
| 4 | aminosilane | 0.3 | St-TFE*1 | 3.0 | — | — | 500 | |
| 5 | aminosilane | 0.3 | methylsilicone | 0.5 | aminosilane | 0.015 | 500 | |
| 6 | aminosilane | 0.5 | polyester | 0.5 | — | — | 500 | |
| 7 | aminosilane | 0.3 | methylsilicone | 0.5 | aminosilane | 0.015 | 500 | |
| 8 | aminosilane | 0.3 | methylsilicone | 1.5 | aminosilane | 0.045 | 500 | |
| 9 | aminosilane | 0.3 | methylsilicone | 0.5 | aminosilane | 0.015 | 760 | *2 |
| 10 | aminosilane | 0.3 | methylsilicone | 0.5 | aminosilane | 0.015 | 500 | |
| 11 | aminosilane | 0.3 | methylsilicone | 0.5 | aminosilane | 0.015 | 500 | |
| 12 | aminosilane | 0.3 | — | — | — | — | 760 | *2 |

(g.: group-containing)
*1: styrene-tetrafluroethylene
*2: No dry nitrogen at the time of coating.

TABLE 2

Carrier Physical Properties

| No. | T $H_2O$—H (wt. %) | T $H_2O$-L (wt. %) | Sm ($cm^2/g$) | T $H_2O$—H/ (100 × Sm) | T $H_2O$-L/ (100 × Sm) | Volume resistivity (Ω · cm) | Magnetization intensity at 1,000/4π ($Am^2/kg$) | Particle diameter D ($\mu$m) | Particle diameter 2/3D≧ (%) |
|---|---|---|---|---|---|---|---|---|---|
| 1 | 0.40 | 0.11 | 462 | $8.66 \times 10^{-6}$ | $2.38 \times 10^{-6}$ | $2.80 \times 10^{12}$ | 35 | 35 | 4.8 |
| 2 | 0.42 | 0.15 | 460 | $9.13 \times 10^{-6}$ | $3.26 \times 10^{-6}$ | $5.40 \times 10^{12}$ | 41 | 35 | 4.5 |
| 3 | 0.58 | 0.24 | 469 | $1.24 \times 10^{-5}$ | $5.12 \times 10^{-6}$ | $9.70 \times 10^{7}$ | 64 | 34 | 4.9 |
| 4 | 0.28 | 0.04 | 475 | $5.89 \times 10^{-6}$ | $8.42 \times 10^{-7}$ | $1.20 \times 10^{16}$ | 26 | 33 | 5.1 |
| 5 | 0.49 | 0.20 | 465 | $1.05 \times 10^{-5}$ | $4.30 \times 10^{-6}$ | $1.20 \times 10^{12}$ | 41 | 35 | 4.8 |
| 6 | 0.68 | 0.25 | 450 | $1.51 \times 10^{-5}$ | $5.56 \times 10^{-6}$ | $2.50 \times 10^{8}$ | 70 | 36 | 4.7 |
| 7 | 0.57 | 0.23 | 447 | $1.28 \times 10^{-5}$ | $5.15 \times 10^{-6}$ | $4.90 \times 10^{12}$ | 39 | 37 | 4.6 |
| 8 | 0.29 | 0.05 | 460 | $6.30 \times 10^{-6}$ | $1.08 \times 10^{-6}$ | $3.40 \times 10^{13}$ | 42 | 35 | 4.6 |
| 9 | 0.56 | 0.22 | 460 | $1.22 \times 10^{-5}$ | $4.78 \times 10^{-6}$ | $3.40 \times 10^{13}$ | 41 | 35 | 4.5 |
| 10 | 0.55 | 0.22 | 460 | $1.20 \times 10^{-5}$ | $4.78 \times 10^{-6}$ | $3.40 \times 10^{13}$ | 40 | 35 | 4.7 |

TABLE 2-continued

| | Carrier Physical Properties | | | | | | | | |
|---|---|---|---|---|---|---|---|---|---|
| | T | T | | T | T | Volume | Magnetization intensity | Particle diameter | |
| No. | $H_2O$—H (wt. %) | $H_2O$-L (wt. %) | Sm ($cm^2/g$) | $H_2O$—H/ (100 × Sm) | $H_2O$-L/ (100 × Sm) | resistivity (Ω · cm) | at 1,000/4π ($Am^2/kg$) | D (μm) | 2/3D≧ (%) |
| 11 | 0.51 | 0.21 | 458 | $1.11 \times 10^{-5}$ | $4.59 \times 10^{-6}$ | $3.40 \times 10^{13}$ | 42 | 35 | 4.6 |
| 12 | 0.60 | 0.25 | 447 | $1.34 \times 10^{-5}$ | $5.59 \times 10^{-6}$ | $1.50 \times 10^{9}$ | 66 | 37 | 4.5 |

TABLE 3

| Toner | Binder resin | Core/shell structure | Weight = average particle diameter (μm) | NaOH extraction peak | SF-1 | External additive (primary-particle number-average particle diameter) (μm) |
|---|---|---|---|---|---|---|
| No. 1 | PE | no | 6.5 | yes | 145 | hydrophobic fine titanium oxide powder (0.02) |
| No. 2 | St-Ac | no | 6.7 | yes | 144 | hydrophobic fine silica powder (0.03) |
| No. 3 | PE | no | 7.0 | no | 146 | hydrophobic fine titanium oxide powder (0.02) |
| No. 4 | PE | no | 6.8 | no | 145 | hydrophobic fine titanium oxide powder (0.02) |
| No. 5 | PE | no | 11.3 | yes | 147 | hydrophobic fine titanium oxide powder (0.02) |
| No. 6 | St-Ac + PE | yes | 6.8 | yes | 115 | hydrophobic fine silica powder (0.03) |
| No. 7 | St-Ac + PE | yes | 6.8 | yes | 115 | hydrophobic fine alumina powder (0.1) |
| No. 8 | St-Ac + PE | yes | 7.3 | yes | 116 | hydrophobic fine silica powder (0.03) |
| No. 9 | St-Ac + PE | yes | 6.8 | yes | 112 | hydrophobic fine silica powder (0.03) |
| No. 10 | St-Ac + PE | yes | 7.5 | yes | 110 | hydrophobic fine silica powder (0.03) |

PE: polyester resin
St-Ac: styrene/n-butyl acrylate copolymer
St-Ac + PE: mixture of styrene/n-butyl acrylate copolymer and polyester resin

TABLE 4

| | | | | N/N | N/L | H/H | | | | |
|---|---|---|---|---|---|---|---|---|---|---|
| | | | | Transfer | Charging | | | | Image density | |
| | Developer No. | Carrier No. | Toner No. | efficiency (%) | rise performance | Chaging stability | Toner scatter | Fog | Initial stage | After 30,000 sh. |
| Example: | | | | | | | | | | |
| 1 | A | 1 | 6 | 98 | A | A | A | A | 1.50 | 1.48 |
| 2 | B | 2 | 6 | 98 | A | A | A | A | 1.50 | 1.49 |
| 3 | C | 3 | 6 | 97 | B | C | C | C | 1.49 | 1.44 |
| 4 | D | 5 | 6 | 98 | A | B | A | A | 1.51 | 1.47 |
| 5 | E | 7 | 6 | 97 | A | C | C | C | 1.52 | 1.47 |
| 6 | F | 8 | 6 | 96 | C | B | A | B | 1.50 | 1.46 |
| 7 | G | 9 | 6 | 95 | A | B | A | C | 1.50 | 1.46 |
| 8 | H | 10 | 6 | 97 | A | B | A | B | 1.50 | 1.46 |
| 9 | I | 11 | 6 | 98 | A | A | A | B | 1.50 | 1.48 |
| 10 | J | 2 | 1 | 93 | B | A | A | A | 1.50 | 1.48 |
| 11 | K | 2 | 2 | 93 | C | C | B | C | 1.50 | 1.45 |
| 12 | L | 2 | 3 | 92 | B | C | C | C | 1.50 | 1.47 |
| 13 | M | 2 | 4 | 92 | B | B | B | B | 1.50 | 1.47 |
| 14 | N | 2 | 5 | 92 | C | C | C | C | 1.50 | 1.45 |
| 15 | O | 2 | 7 | 98 | A | B | A | B | 1.52 | 1.48 |
| Comparative Example: | | | | | | | | | | |
| 1 | P | 4 | 3 | 94 | F | D | C | C | 1.50 | 1.39 |
| 2 | Q | 6 | 3 | 96 | D | E | E | F | 1.50 | 1.60 |
| 3 | R | 12 | 3 | 96 | D | C | C | D | 1.50 | 1.45 |

What is claimed is:

1. A carrier for use in electrophotography, comprising carrier cores comprising a binder resin and metal compound particles dispersed therein, and a coating resin for coating the surfaces of the carrier cores, wherein;

water adsorption $T_{H2O-H}$ (% by weight) after the carrier has been left in an environment of 30° C./80% RH, water adsorption $T_{H2O-L}$ (% by weight) after the carrier has been left in an environment of 23° C./5% RH, and particle surface area Sm ($cm^2/g$) of the carrier satisfy the following relationship.

$$6.00\times10^{-6}\leqq T_{H2O-H}/(100\times Sm)\leqq 1.50\times10^{-5},$$

and $$1.00\times10^{-6}\leqq T_{H2O-L}/(100\times Sm)\leqq 5.50\times10^{-6}.$$

2. The carrier according to claim 1, which has a specific resistance of from $1\times10^8$ to $1\times10^{16}$ Ω·cm and a magnetization intensity at 1,000/4 π kA/m of from 20 to 100 $Am^2/kg$.

3. The carrier according to claim 1, wherein said carrier cores contain at least two types of the metal compound particles, the metal compound particles are in a proportion of from 80% by weight to 99% by weight based on the weight of the binder resin, and the metal compound particles comprise a ferromagnetic material and a non-magnetic metal compound having a higher specific resistance than the ferromagnetic material; said ferromagnetic material being in a proportion of from 50% by weight to 95% by weight based on the total weight of the metal compound particles.

4. The carrier according to claim 3, wherein said carrier cores contain magnetite as the ferromagnetic material and contains hematite as at least one of the metal compound having high specific resistance.

5. The carrier according to claim 1, wherein said binder resin comprises a thermosetting resin having a cross-linked structure.

6. The carrier according to claim 1, wherein said binder resin comprises a phenolic resin.

7. The carrier according to claim 6, wherein said phenolic resin is a phenolic resin obtained in the presence of an ammonia catalyst.

8. The carrier according to claim 3, wherein the surfaces of said metal compound particles have been treated with a lipophilic-treating agent having at least one functional group selected from an epoxy group, an amino group and a mercapto group.

9. The carrier according to claim 3, wherein the surfaces of said metal compound particles have been treated with a lipophilic-treating agent having at least an epoxy group.

10. The carrier according to claim 1, wherein the surfaces of said carrier cores have been coated with a silicone resin.

11. The carrier according to claim 1, wherein the surfaces of said carrier cores have been coated with a silicone resin containing a coupling agent.

12. The carrier according to claim 11, wherein said coupling agent comprises an aminosilane.

13. The carrier according to claim 1, wherein the surfaces of said carrier cores have been treated with a coupling agent and thereafter coated with a silicone resin.

14. The carrier according to claim 13, wherein said coupling agent comprises an aminosilane.

15. A two-component type developer comprising a toner and a carrier, wherein;

said toner contains at least a binder resin and a colorant and has a weight-average particle diameter of from 3 μm to 10 μm;

said carrier has carrier cores comprising a binder resin and metal compound particles dispersed therein, and a coating resin for coating the surfaces of the carrier cores; and water adsorption $T_{H2O-H}$ (% by weight) after the carrier has been left in an environment of 30° C./80% RH, water adsorption $T_{H2O-L}$ (% by weight) after the carrier has been left in an environment of 23° C./5% RH, and particle surface area Sm ($cm^2/g$) of the carrier satisfy the following relationship.

$$6.00\times10^{-6}\leqq T_{H2O-H}/(100\times Sm)\leqq 1.50\times10^{-5},$$

and $$1.00\times10^{-6}\leqq T_{H2O-L}/(100\times Sm)\leqq 5.50\times10^{-6}.$$

16. The developer according to claim 15, wherein said carrier has a specific resistance of from $1\times10^8$ to $1\times10^{16}$ Ω·cm and a magnetization intensity at 1,000/4 π kA/m of from 20 to 100 $Am^2/kg$.

17. The developer according to claim 15, wherein said carrier cores contain at least two types of the metal compound particles, the metal compound particles are in a proportion of from 80% by weight to 99% by weight based on the weight of the binder resin, and the metal compound particles comprise a ferromagnetic material and a non-magnetic metal compound having a higher specific resistance than the ferromagnetic material; said ferromagnetic material being in a proportion of from 50% by weight to 95% by weight based on the total weight of the metal compound particles.

18. The developer according to claim 17, wherein said carrier cores contain magnetite as the ferromagnetic material and contains hematite as at least one of the metal compound having high specific resistance.

19. The developer according to claim 15, wherein said binder resin comprises a thermosetting resin having a cross-linked structure.

20. The developer according to claim 15, wherein said binder resin comprises a phenolic resin.

21. The developer according to claim 20, wherein said phenolic resin is a phenolic resin obtained in the presence of an ammonia catalyst.

22. The developer according to claim 17, wherein the surfaces of said metal compound particles have been treated with a lipophilic-treating agent having at least one functional group selected from an epoxy group, an amino group and a mercapto group.

23. The developer according to claim 17, wherein the surfaces of said metal compound particles have been treated with a lipophilic-treating agent having at least an epoxy group.

24. The developer according to claim 15, wherein the surfaces of said carrier cores have been coated with a silicone resin.

25. The developer according to claim 15, wherein the surfaces of said carrier cores have been coated with a silicone resin containing a coupling agent.

26. The developer according to claim 25, wherein said coupling agent comprises an aminosilane.

27. The developer according to claim 15, wherein the surfaces of said carrier cores have been treated with a coupling agent and thereafter coated with a silicone resin.

28. The developer according to claim 27, wherein said coupling agent comprises an aminosilane.

29. The developer according to claim 15, wherein said toner comprises as the binder resin a polyester resin.

30. The developer according to claim 15, wherein said toner has at least one peak in the range of from 280 nm to 350 nm when its absorbance is measured on an extract obtained by extraction with 0.1 mol/liter of sodium hydroxide.

31. The developer according to claim 15, wherein said toner has a shape factor SF-1 of from 100 to 120.

32. The developer according to claim 15, wherein said toner has a core/shell structure, and the core is formed of a low-softening substance.

33. The developer according to claim 15, wherein said toner has, as an external additive, fine particles selected from the group consisting of fine silica particles, fine titanium oxide particles and a mixture of these.

34. An image-forming method comprising the steps of;

charging an electrostatic latent image bearing member electrostatically by a charging means;

exposing the electrostatic latent image bearing member thus charged, to form an electrostatic latent image on the electrostatic latent image bearing member;

developing the electrostatic latent image by a developing means having a two-component type developer, to form a toner image on the electrostatic latent image bearing member;

transferring the toner image formed on the electrostatic latent image bearing member, to a transfer medium via, or not via, an intermediate transfer member; and fixing the toner image transferred onto the transfer medium, by a heat-and-pressure fixing means; wherein;

said two-component type developer has at least a toner and a magnetic-material-dispersed resin carrier; the toner contains at least a binder resin for a toner and a colorant and has a weight-average particle diameter of from 3 $\mu$m to 10 $\mu$m;

the magnetic-material-dispersed resin carrier has carrier cores comprising a binder resin and metal compound particles dispersed therein, and a coating resin for coating the surfaces of the carrier cores; and water adsorption $T_{H2O\text{-}H}$ (% by weight) after the carrier has been left in an environment of 30° C./80% RH, water adsorption $T_{H2O\text{-}L}$ (% by weight) after the carrier has been left in an environment of 23° C./5% RH, and particle surface area Sm ($cm^2/g$) of the carrier satisfy the following relationship.

$$6.00\times10^{-6} \leqq T_{H2O\text{-}H}/(100\times Sm) \leqq 1.50\times10^{-5},$$

and $$1.00\times10^{-6} \leqq T_{H2O\text{-}L}/(100\times Sm) \leqq 5.50\times10^{-6}.$$

35. The method according to claim 34, wherein said carrier has a specific resistance of from $1\times10^8$ to $1\times10^{16}$ $\Omega\cdot$cm and a magnetization intensity at 1,000/4 $\pi$ kA/m of from 20 to 100 $Am^2/kg$.

36. The method according to claim 34, wherein said carrier cores contain at least two types of the metal compound particles, the metal compound particles are in a proportion of from 80% by weight to 99% by weight based on the weight of the binder resin, and the metal compound particles comprise a ferromagnetic material and a non-magnetic metal compound having a higher specific resistance than the ferromagnetic material; said ferromagnetic material being in a proportion of from 50% by weight to 95% by weight based on the total weight of the metal compound particles.

37. The method according to claim 36, wherein said carrier cores contain magnetite as the ferromagnetic material and contains hematite as at least one of the metal compound having high specific resistance.

38. The method according to claim 34, wherein said binder resin comprises a thermosetting resin having a cross-linked structure.

39. The method according to claim 34, wherein said binder resin comprises a phenolic resin.

40. The method according to claim 39, wherein said phenolic resin is a phenolic resin obtained in the presence of an ammonia catalyst.

41. The method according to claim 36, wherein the surfaces of said metal compound particles have been treated with a lipophilic-treating agent having at least one functional group selected from an epoxy group, an amino group and a mercapto group.

42. The method according to claim 36, wherein the surfaces of said metal compound particles have been treated with a lipophilic-treating agent having at least an epoxy group.

43. The method according to claim 34, wherein the surfaces of said carrier cores have been coated with a silicone resin.

44. The method according to claim 34, wherein the surfaces of said carrier cores have been coated with a silicone resin containing a coupling agent.

45. The method according to claim 44, wherein said coupling agent comprises an aminosilane.

46. The method according to claim 34, wherein the surfaces of said carrier cores have been treated with a coupling agent and thereafter coated with a silicone resin.

47. The method according to claim 46, wherein said coupling agent comprises an aminosilane.

48. The method according to claim 34, wherein said toner comprises as the binder resin a polyester resin.

49. The method according to claim 34, wherein said toner has at least one peak in the range of from 280 nm to 350 nm when its absorbance is measured on an extract obtained by extraction with 0.1 mol/liter of sodium hydroxide.

50. The method according to claim 34, wherein said toner has a shape factor SF-1 of from 100 to 120.

51. The method according to claim 34, wherein said toner has a core/shell structure, and the core is formed of a low-softening substance.

52. The method according to claim 34, wherein said toner has, as an external additive, fine particles selected from the group consisting of fine silica particles, fine titanium oxide particles and a mixture of these.

53. The method according to claim 34, wherein said developing means has a developing sleeve internally provided with a magnetic field generation means, and the electrostatic latent image is developed with the toner of said two-component type developer while applying an alternating bias to the developing sleeve.

54. The method according to claim 53, wherein said alternating bias has a waveform which continuous or discontinuous.

55. The method according to claim 34, wherein said electrostatic latent image is a digital latent image, and the digital latent image is developed by reverse development.

56. The method according to claim 34, wherein said electrostatic latent image bearing member is a photosensitive drum having an organic photoconductor photosensitive layer.

* * * * *

UNITED STATES PATENT AND TRADEMARK OFFICE

CERTIFICATE OF CORRECTION

PATENT NO. : 6,372,400 B1
DATED : June 29, 2000
INVENTOR(S) : Kazumi Yoshizaki et al.

It is certified that error appears in the above-identified patent and that said Letters Patent is hereby corrected as shown below:

Column 3,
Line 35, "Tend" should read -- tends --.

Column 17,
Line 12, "an" should read -- a --.

Column 19,
Line 4, "an" (second occurrence) should be deleted.

Column 20,
Line 22, "a little vary" should read -- vary a little --.

Column 30,
Line 8-9, "(ethylene-propyleneimine terpolymer)" should read -- (ethylene-propylenediene terpolymer) --.

Column 40,
Table 1, "nom-magnetic" should read -- non-magnetic --.

Column 46,
Line 57, "continuous" should read -- is continuous --; and
Line 64, "photoconductor" should read -- non-magnetic --.

Signed and Sealed this

Twentieth Day of August, 2002

*Attest:*

*Attesting Officer*

JAMES E. ROGAN
*Director of the United States Patent and Trademark Office*